US011034472B2

(12) United States Patent
Marelin

(10) Patent No.: US 11,034,472 B2
(45) Date of Patent: Jun. 15, 2021

(54) BAND TENSIONING TOOL AND CALIBRATION DEVICE THEREFOR

(71) Applicant: Band-It-IDEX, Inc., Denver, CO (US)

(72) Inventor: Miklos B. Marelin, Aurora, CO (US)

(73) Assignee: Band-It-IDEX, Inc., Denver, CO (US)

( * ) Notice: Subject to any disclaimer, the term of this patent is extended or adjusted under 35 U.S.C. 154(b) by 756 days.

(21) Appl. No.: 15/280,848

(22) Filed: Sep. 29, 2016

(65) Prior Publication Data

US 2017/0015449 A1 Jan. 19, 2017

Related U.S. Application Data

(63) Continuation-in-part of application No. 14/685,330, filed on Apr. 13, 2015, now abandoned.

(60) Provisional application No. 61/990,339, filed on May 8, 2014, provisional application No. 62/239,635, filed on Oct. 9, 2015.

(51) Int. Cl.

| | |
|---|---|
| ***B65B 13/02*** | (2006.01) |
| ***B65B 13/34*** | (2006.01) |
| ***B26D 5/14*** | (2006.01) |
| ***B26D 5/10*** | (2006.01) |
| *B26D 1/00* | (2006.01) |
| *B26D 7/00* | (2006.01) |

(52) U.S. Cl.

CPC ..... *B65B 13/027* (2013.01); *B26D 5/10* (2013.01); *B26D 5/14* (2013.01); *B65B 13/345* (2013.01); *B26D 2001/0066* (2013.01); *B26D 2007/0093* (2013.01)

(58) Field of Classification Search

CPC ... B65B 13/027; B65B 13/185; B65B 13/345; B65B 13/305; B65B 13/025; B65B 13/30; B65B 13/34

USPC ..... 140/150, 152

See application file for complete search history.

(56) References Cited

U.S. PATENT DOCUMENTS

| | | | | |
|---|---|---|---|---|
| 3,782,426 A | | 1/1974 | Morgan et al. | |
| 4,896,402 A | | 1/1990 | Jansen et al. | |
| 4,934,416 A | | 6/1990 | Tonkiss | |
| 5,000,232 A | | 3/1991 | Wolcott | |
| 5,111,853 A | | 5/1992 | Scruggs | |
| 5,127,446 A | | 7/1992 | Marelin | |
| 5,322,091 A | | 6/1994 | Marelin | |
| 5,483,998 A | * | 1/1996 | Marelin | B25B 25/005 140/150 |
| 5,492,156 A | * | 2/1996 | Dyer | B21F 9/02 140/123.6 |
| 5,566,726 A | | 10/1996 | Marelin | |
| 5,597,018 A | | 1/1997 | Shipman | |
| 5,743,310 A | | 4/1998 | Moran | |

(Continued)

FOREIGN PATENT DOCUMENTS

| | | |
|---|---|---|
| JP | S49-099683 | 8/1974 |
| WO | WO 2014/024296 | 2/2014 |

OTHER PUBLICATIONS

Official action for Canadian Patent Application No. 2,948,352, dated May 14, 2018, 5 pages.

(Continued)

*Primary Examiner* — Gregory D Swiatocha
(74) *Attorney, Agent, or Firm* — Sheridan Ross P.C.

(57) ABSTRACT

A method and apparatus for securing a cable tie about an object is described. Further, a relatively compact banding tool that facilitates cable tie tensioning is described.

16 Claims, 22 Drawing Sheets

(56) References Cited

U.S. PATENT DOCUMENTS

| | | | | |
|---|---|---|---|---|
| 5,832,964 | A * | 11/1998 | Joshi | B65B 13/027 140/123.6 |
| 7,063,110 | B2 | 6/2006 | Chen | |
| 7,438,094 | B2 * | 10/2008 | Hillegonds | B21F 9/02 100/30 |
| 7,650,680 | B2 | 1/2010 | Stillings et al. | |
| 2005/0284534 | A1 | 12/2005 | Chen | |
| 2008/0209692 | A1 * | 9/2008 | Caveney | B65B 13/027 24/20 R |
| 2013/0199382 | A1 | 8/2013 | Armijo | |
| 2015/0239588 | A1 * | 8/2015 | Kitago | B65B 13/22 140/123.6 |
| 2015/0321778 | A1 | 11/2015 | Marelin | |
| 2015/0336694 | A1 | 11/2015 | Skonieczny, Jr. | |

OTHER PUBLICATIONS

Official Action for U.S. Appl. No. 14/685,330, dated May 16, 2018, 13 pages.
Advisory Action for U.S. Appl. No. 14/685,330, dated Jul. 23, 2018, 6 pages.
Official Action for Canadian Patent Application No. 2,948,352, dated Sep. 25, 2017, 3 pages.
Official Action (with English translation) for Chinese Patent Application No. 201580031962.6, dated Nov. 29, 2017, 17 pages.
Official Action for U.S. Appl. No. 14/685,330, dated Jan. 26, 2018, 19 pages.
International Search Report and Written Opinion for International (PCT) Patent Application No. PCT/US15/29840, dated Aug. 14, 2015, 13 pages.
International Preliminary Report on Patentability for International (PCT) Patent Application No. PCT/US15/29840, dated Nov. 17, 2016, 7 pages.
International Search Report and Written Opinion for International (PCT) Patent Application No. PCT/US17/53595, dated Dec. 19, 2017, 8 pages.
Extended European Search Report for European Patent Application No. 15789562.4, dated Dec. 6, 2017, 6 pages.
Official Action (with English translation) for Chinese Patent Application No. 201580031962.6, dated Jul. 30, 2018, 11 pages.
Notice of Allowance (with English translation) for Chinese Patent Application No. 201580031962.6, dated Jan. 14, 2019, 5 pages.
Official Action (with English translation) for Japanese Patent Application No. 2017-511551, dated Feb. 22, 2019, 5 pages.
International Preliminary Report on Patentability for International (PCT) Patent Application No. PCT/US17/53595, dated Apr. 2, 2019.
Official Action (with English translation) for Japanese Patent Application No. 2017-511551, dated Dec. 3, 2019, 5 pages.
Decision to Grant (with English translation) Japanese Patent Application No. 2017-511551, dated Sep. 8, 2020, 5 pages.

* cited by examiner

BAND TENSIONING TOOL AND CALIBRATION DEVICE THEREFOR

This application is a Continuation-In-Part of U.S. patent application Ser. No. 14/685,330, filed Apr. 13, 2015, which claims the benefit of U.S. Provisional Patent Application Ser. No. 61/990,339, filed May 8, 2014, the entirety of which is incorporated by reference herein.

This application also claims the benefit of U.S. Provisional Patent Application Ser. No. 62/239,635, filed Oct. 9, 2015, the entirety of which is incorporated by reference herein.

This application is related to U.S. Pat. Nos. 5,566,726 and 4,896,402, the entire disclosures of which are incorporated by reference herein.

This application is also related to U.S. Patent Application Publication No. 2013/0199382, the entirety of which is incorporated by reference herein.

FIELD OF THE INVENTION

Embodiments of the present invention relate to a method and apparatus for securing a cable tie about an object, and in particular, to a relatively compact banding tool that facilitates cable tie tensioning.

BACKGROUND OF THE INVENTION

Cable ties, which are sometimes referred to as "band clamps," are typically used to bundle wires, secure back shells to cables, secure heat shields to pipes, and secure signage to poles. Cable ties are generally comprised of a band with an interconnected head that secures a free end of the band after a predetermined band tension has been applied. Some bands have had operatively interconnected heads (or buckles or seals), instead of an integrated head.

Tensioning tools are used to tighten cable ties. For example, the tensioning tool described in U.S. Pat. No. 5,566,726 employs a band gripping mechanism (also denoted a "tension block") that repeatedly grips and incrementally moves a portion of the band, which tensions the band. More specifically, to tension the band, the tension block is first moved along a length of the band in a first direction, generally toward objects being banded, e.g. wires. The tension block then engages the band and moves a portion of the same away from the objects being banded which incrementally tensions the band. The tension block grips the band with a pin having an axis that is oriented along the width of the band. The pin may be biased by a spring, or other biasing device, to ensure firm engagement with the band when the tension block is pulled away from the objects being banded. After the tension block has moved its full extent away from the objects being banded, the tension block is released from the band so that it can be moved to another location on the band to begin another incremental tension cycle. Band tension is maintained by a front gripper that selectively contacts the band between the tension block and the objects being banded when the tension block is moved from one location on the band to another.

FIG. 1 shows a band tensioning tool 2 of the prior art and illustrates the tensioning steps described above. Here, the tension block 6 is shown with the front gripper 10 spaced therefrom. The band 14 is positioned through the tension block 6 and the front gripper 10. The tension block 6 includes a proximal end 18, which is closer to the objects being banded 22, and a distal end 26. The dashed outline of the tension block 6 represents the movement of the proximal end 18 towards the objects 22. The tension block 6 further includes a platform 30 that supports the band 14 as it passes through the tension block 6. The tension block 6 also includes a lateral opening 34 that inclines toward the platform 30 toward the proximal end 18 of the tension block 6. The tension block 6 further includes a gripping pin (or gripper) 38 that is operatively positioned and movable within the lateral opening 34. The pin 38 is biased by a biasing member (not shown) that moves the gripping pin 38 in the direction of arrow 40 to firmly engage the band 14. When the tension block 6 moves in the direction of arrow 44, the gripping pin 38 is not biased and is able to slide on the surface of the band 12. However, when the tension block 6 is moved away from the objects 22 (i.e., in the direction of arrow 48), the gripping pin 38 moves toward a proximal end 52 of the lateral opening 34 and frictionally engages and grips the band 14.

The front gripper 10 also includes an inclined lateral opening 56 and a gripping pin 60 that moves within the opening 56. The gripping pin 60 is biased toward a proximal end 64 of the opening 56. When the tension block 6 is not tensioning the band 14, i.e., moving in the direction of arrow 44, the gripping pin 60 of the front gripper 10 frictionally engages the band 14 so that it is not slackened by a band tension counterforce acting in the direction of arrow 68. Once the tension block 6 has completed its movement toward the front gripper 10, it reverses direction, thereby causing the gripping pin 38 to securely engage the band 14 and pull it in the direction of arrow 48. Movement of the band 14 in the direction of arrow 48 causes the gripping pin 60 to disengage from the band 16, thereby allowing the band 14 to be pulled into the band tightening tool 2.

Tensioning tools often employ a device for firmly interconnecting the band to the head and a device for severing the excess band from the tensioned cable tie. Some tools combine this functionality. For example, FIG. 2 shows the interconnection of the blade 70 to a tool head 74. Here, the prior art blade 70 is shown rotatably interconnected to the tool head 74 via a pin 78 attached to sidewalls of the tool head 74. Forces acting on the blade 70, which are generated by the knife 82, will be reacted by the pin 78. Forces will also be transmitted through the pin 78 to the sidewalls of the tool head, which often weakens or damages the same.

Again, after the tension block and the front gripper perform their respective duties, the band is severed and clamped, i.e., locked to a buckle or seal. A stationary blade is provided beneath the front gripper and a movable knife is provided forward of the front gripper. The knife moves relative to the blade to sever a band located therebetween. More specifically, once the desired band tension is achieved, a linkage is used to move the knife closer to the blade which compresses the band and eventually severs the same. The gap between the knife edge and the blade edge is preferably maintained within a predetermined tolerance that will ensure bands are cut in the most effective manner, even after many cutting cycles.

One drawback of prior art tensioning tools is that downward pressure from the knife is transmitted through the band and to the blade, which stresses the blade and adversely affects its effectiveness. Band cutting is also adversely affected because the blade edge is spaced from the blade's attachment point, i.e., the location where pressure acting on the blade's cutting edge is reacted. Over time, the blade may be prone to flex, which can lead to fatigue and ultimately failure.

One of ordinary skill in the art will appreciate that cutting will eventually weaken the blade and cause it to yield or fracture. Unfortunately, the failure rate and mode is unpredictable, wherein the blade may fail after 100, 200, or 1000 bands are tensioned. When blades fail, the tools are shipped from the end user to the factory for blade or knife replacement, which is expensive, costly, and time consuming.

As alluded to above, blade support of prior art tools is not ideal and blade damage is common. The primary failure mode is blade edge degradation and, in some instances, fracture. More specifically, the blade of prior art tools is rotatably interconnected to a tool head. Further, the blade of some prior art tools possesses an internal non-cutting edge that engages the tool head to react loads generated at an external cutting edge of the blade when the knife contacts the band positioned between the knife and the blade. This complex design came from a desire to provide a blade with two edges such that when one was damaged, the blade could be removed and rotated to locate the previously non-used blade adjacent to the knife.

Another drawback of prior art tensioning tools is that the knife does not travel in a smooth, continuous manner, thus a gap between the knife and the blade is not consistent, which affects cutting performance and can increase blade loads. For example, if the space between the knife's cutting edge and the blade's cutting edge is too wide, knife travel may be inadequate to sever the band as material will deform between the knife edge in the blade edge. If the gap is too narrow, excess loads generated by the knife will be transferred to the blade and cause damage.

In view of the foregoing, there exists a need for a banding tool that maintains tolerance between the knife and blade, which increases blade life.

SUMMARY OF THE INVENTION

In accordance with one aspect of the invention, a band tensioning tool is provided that includes a tensioning mechanism having a first longitudinal axis therethrough. The tensioning mechanism comprises a force storing device within a tool handle. A tension adjustment plunger, a tension adjustment screw, and a connecting rod are interconnected to the force storing device and to tension transferring device. In one embodiment, the force storing device is a compression spring that is pre-compressed to a desired amount by the adjustment plunger.

The tension transferring device comprises a tension transfer lever interconnected to the tensioning device and a tensioning block. At least one push link is connected on a first end thereof to the tensioning device, and on a second end to a lever arm. The tension block, which has an elongated slot and a tension pin, is connected to the lever arm, wherein the tension block pulls the band into tension.

It is still yet another aspect the present invention to provide a knife with an arcuate cutting edge and a head deformation surface. More specifically, the cutting edge of one embodiment of the present invention initially contacts the band and is used with the blade to sever the band. Thereafter, the deformation surface of the knife is adapted to contact the cable tie's locking feature, e.g., the cable tie head, and deforms the same. Deforming the head will change its geometry and, thus, change its moment of inertia and strength. As the head is designed to maintain band tension, those of ordinary skill in the art will appreciate that increased head stiffness will maximize the cable tie's retained force. The knife of one embodiment of the present invention also removes sharp corners and provides a smooth cut, which is desirable for safety.

Tools of embodiments of the present invention are designed to tension and secure various types of band clamps and cable ties. Some versions of the contemplated tool are suited to secure cable ties commonly sold by the assignee of the instant application under the trademark TIE-DEX®, which are described in U.S. Pat. No. 4,896,402. As one of skill in the art will appreciate, it is often desirable to reduce cable tie weight, which can be accomplished if tie thickness is reduced. Accordingly, it is one aspect of embodiments of the present invention to provide a cable tie of reduced thickness made of tempered stainless steel. In applications where a reduced diameter banding is required, the thinner band will perform better than the current cable ties.

Existing tools often have difficulty in cutting thinner cable ties. More specifically, because of tolerance stack between the cutter knife (moving portion) and the blade (stationary portion), the gap between the two components that affect cutting may vary over time. Often, the gap will generally increase over time and the cable tie will deform instead of severing as a knife passes the blade. It is thus another aspect of the present invention to control the distance between the blade's cutting surface and the knife. By maintaining a tight tolerance between these two components, thinner bands can be formed and severed without bending.

One embodiment of the present invention achieves this goal of maintaining tight tolerances by including a blade with an integrated knife housing. The knife housing includes a channel that slidingly receives the knife. In this fashion the tolerance between the knife and the blade is maintained because the knife's movement is limited by the knife channel. The blade edge also interacts with a load point that is near the blade edge, which reduces damaging loads acting on the blade. Furthermore, by maintaining the tolerance between the knife and the blade edge, the gap between these two components can be maintained after many uses.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
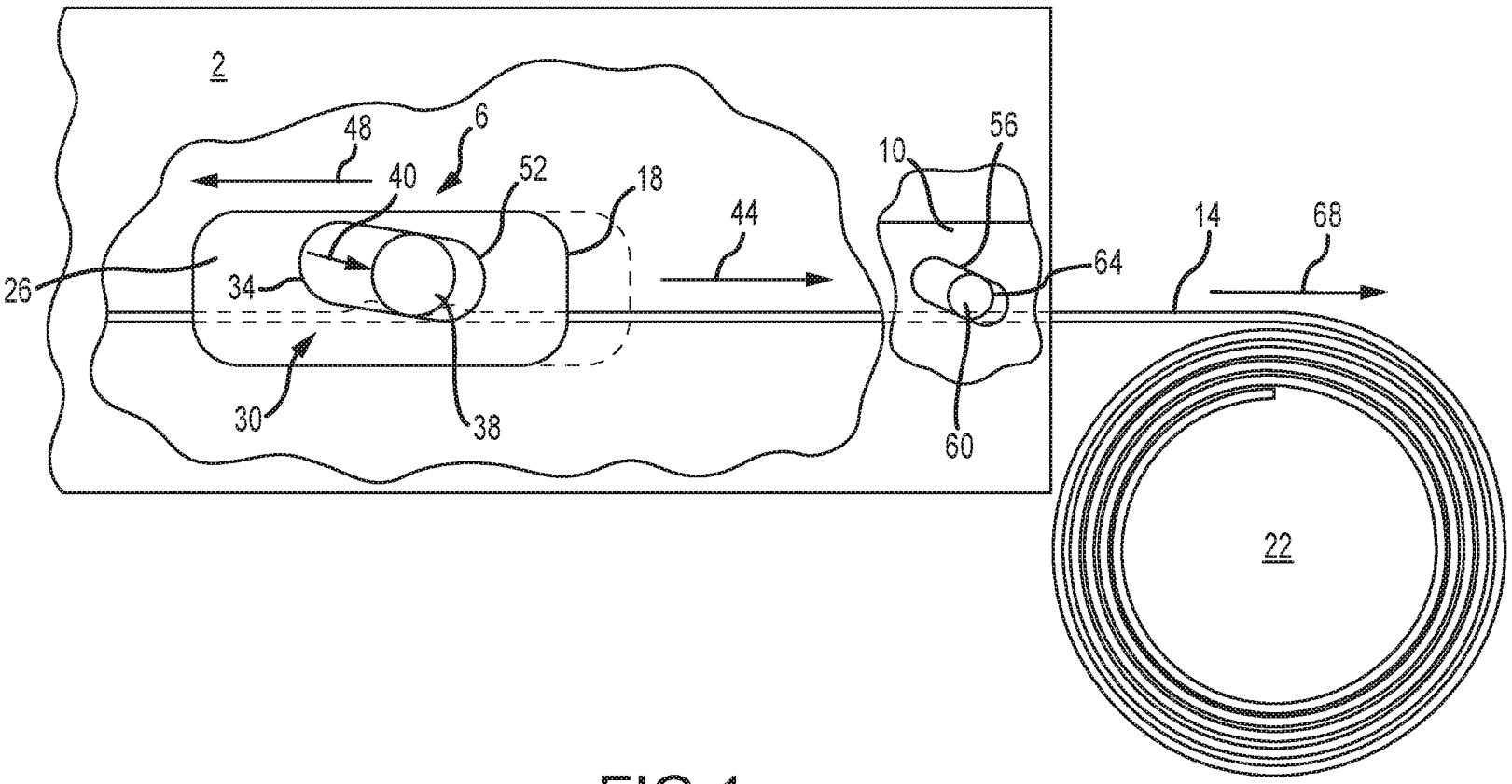
FIG.1 PRIOR ART
FIG. 1 is a cross sectional view showing a band tensioning device of the prior art.
Figure 2:
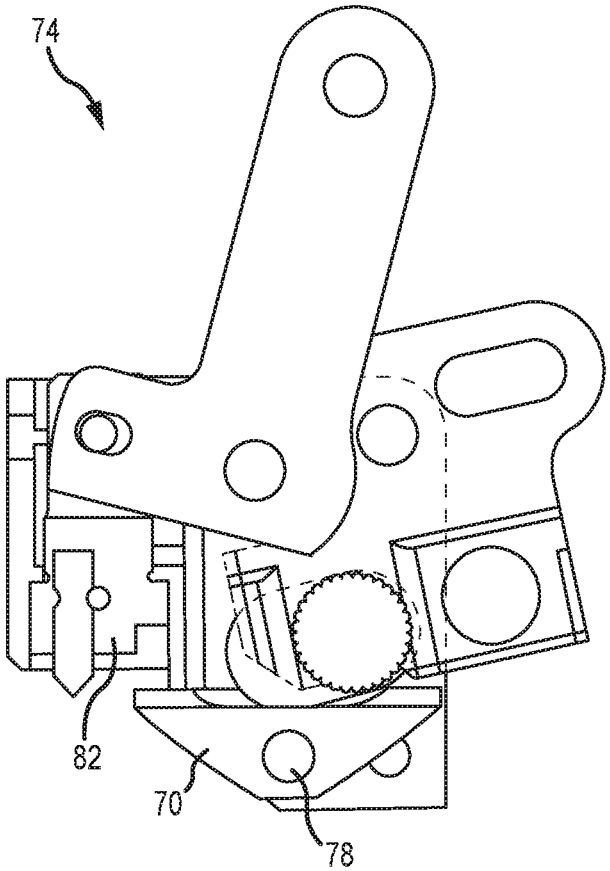
FIG.2 PRIOR ART
FIG. 2 is a cross sectional view showing a knife and blade of the prior art.
Figure 3:
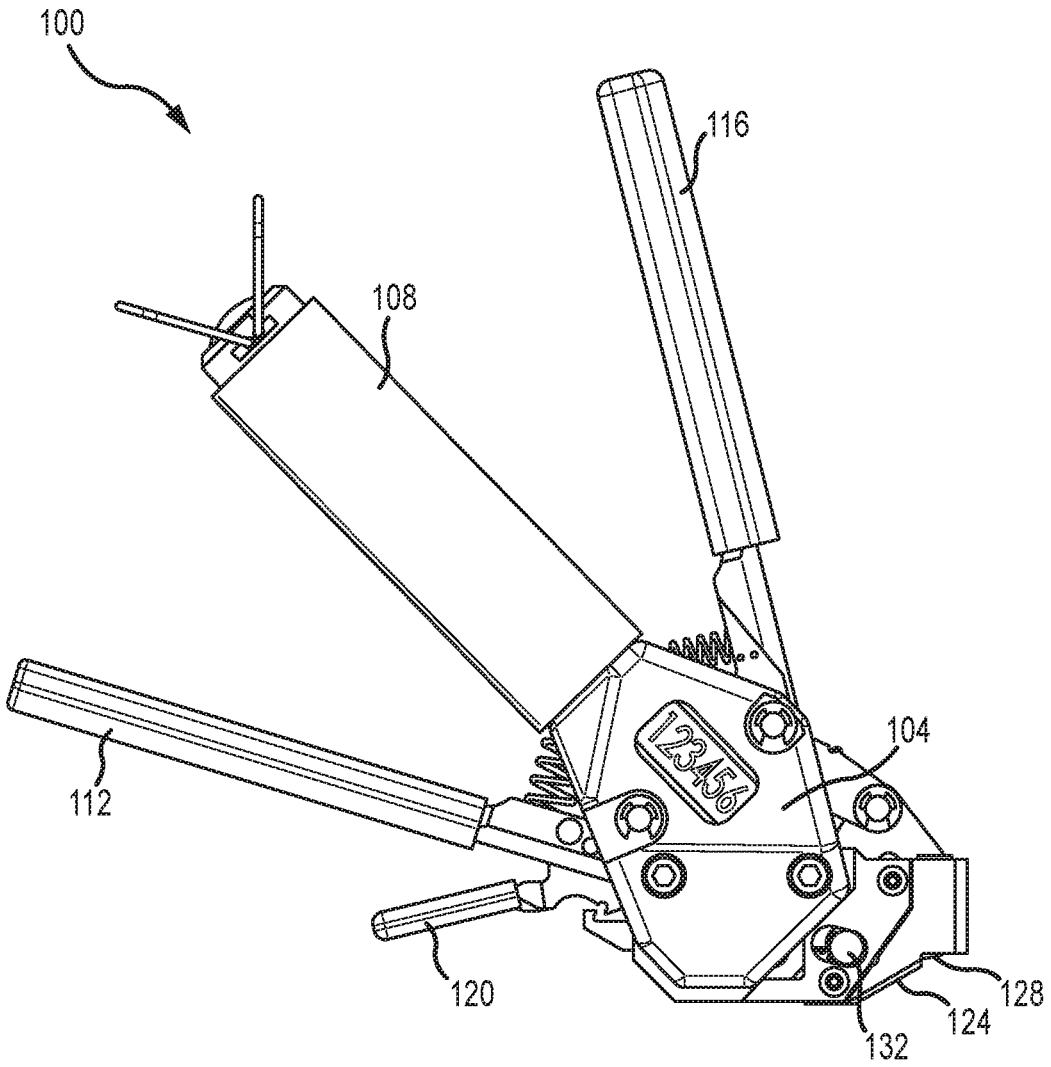
FIG. 3 is a side elevation view of one embodiment of the present invention.
Figure 4:
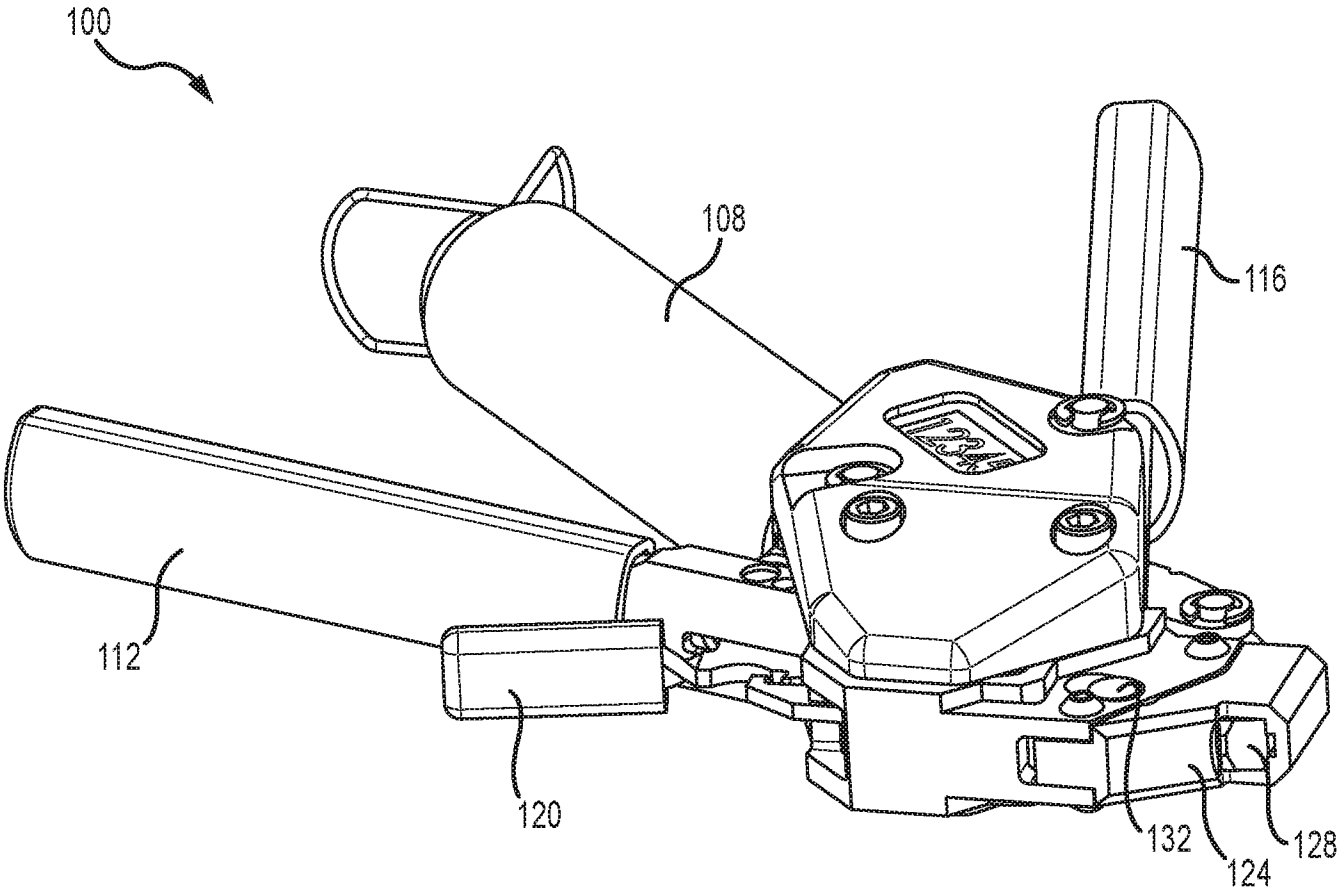
FIG. 4 is a bottom perspective view of FIG. 3.
Figure 5:
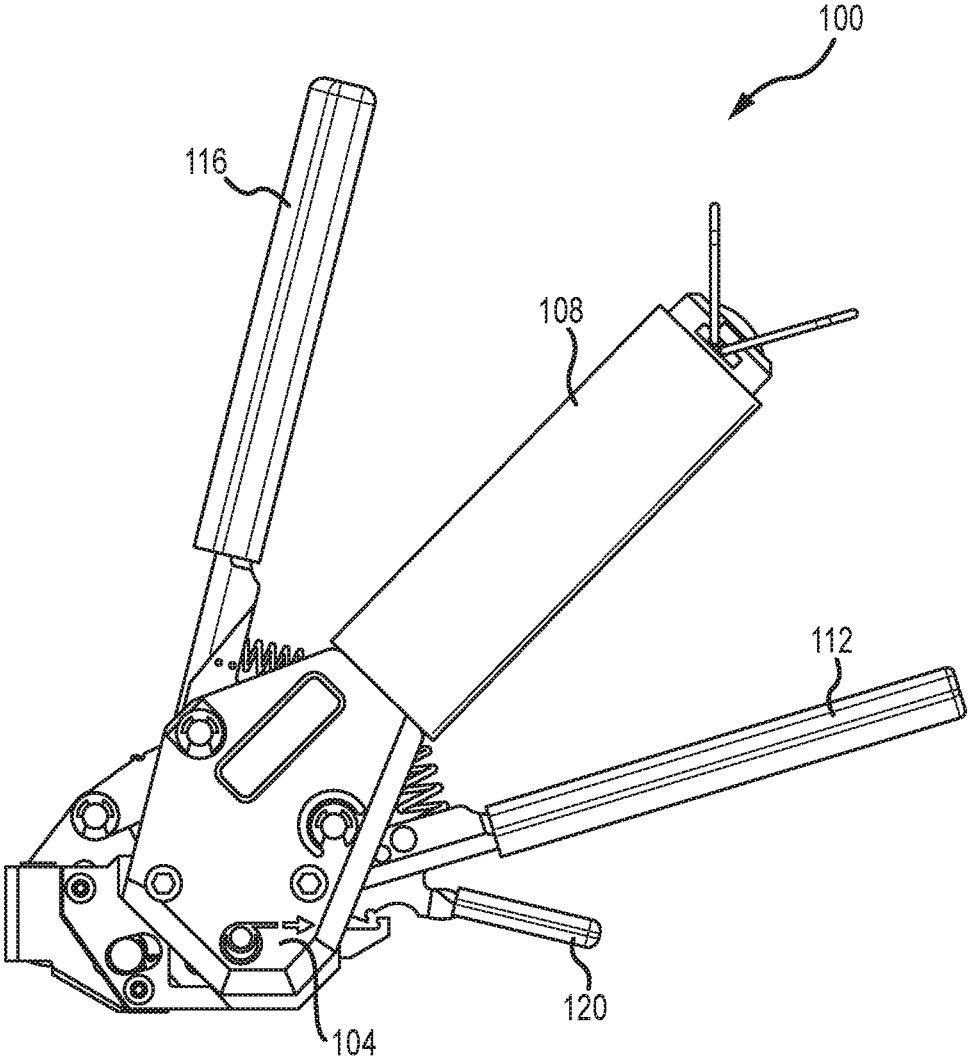
FIG. 5 is a side elevation view opposite to that of FIG. 3.
Figure 6:
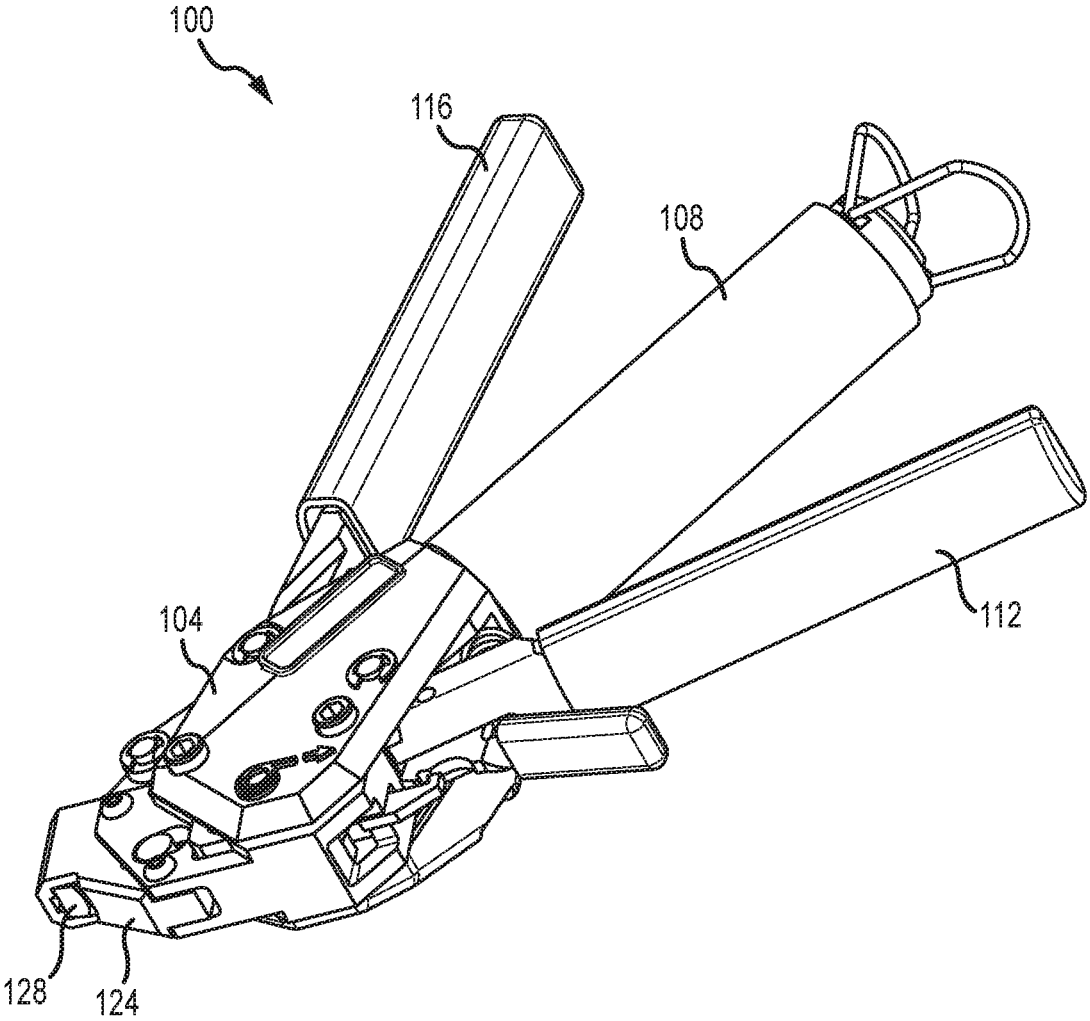
FIG. 6 is another bottom perspective view.

To assist in the understanding of one embodiment of the present invention the following list of components and associated numbering found in the drawings is provided herein:

| # | Component |
|---|---|
| 2 | Band tensioning tool |
| 6 | Tension block |
| 10 | Front gripper |
| 14 | Band |
| 18 | Proximal end |
| 22 | Objects |
| 26 | Distal end |
| 30 | Platform |
| 34 | Lateral opening |
| 38 | Gripping pin |
| 52 | Proximal end |

-continued

| # | Component |
|---|---|
| 56 | Lateral opening |
| 60 | Gripping pin |
| 64 | Proximal end |
| 70 | Blade |
| 74 | Tool head |
| 78 | Pin |
| 82 | Knife |
| 100 | Banding tensioning tool |
| 104 | Head |
| 108 | Handle |
| 112 | Tension handle |
| 116 | Cutoff handle |
| 120 | Hook |
| 124 | Blade |
| 128 | Knife |
| 132 | Front gripper |
| 136 | Spring |
| 140 | Rod |
| 144 | Transfer lever |
| 148 | Tension block |
| 152 | Gripper |
| 156 | Band |
| 158 | Buckle |
| 160 | Cutter arm |
| 164 | Housing |
| 168 | Knife channel |
| 172 | Channel |
| 176 | Blade edge |
| 178 | Arrow |
| 180 | Cutting Edge |
| 184 | Deformation Surface |
| 200 | Pneumatic tool |
| 300 | Band tensioning tool |
| 304 | Head |
| 306 | Handle |
| 312 | Tension handle |
| 316 | Cutoff handle |
| 324 | Blade |
| 328 | Knife |
| 332 | Front gripper |
| 370 | Blade housing |
| 372 | Channel |
| 374 | Protrusion |
| 378 | Recess |
| 382 | Cutter link |
| 400 | Calibration device |
| 404 | Gauge body |
| 408 | Hook |
| 412 | Slot |
| 416 | Magnet |
| 420 | Distal end |
| 424 | Plate |
| 428 | Screw |
| 432 | Aperture |
| 436 | Stop |
| 440 | Stationary arm |
| 444 | Movable arm |
| 446 | Band head |
| 448 | Proximal end |
| 452 | Adjustment screw |
| 456 | End |
| 460 | Opening |
| 464 | Band |
| 468 | Forward opening |
| 472 | Rear opening |
| 478 | Inner surface |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 3-6 show a banding tool 100 of embodiments of the present invention that is designed to tension and secure a band clamp comprising a band and a band locking head. The banding tool 100 includes a head 104 interconnected to a handle 108. A tension handle 112 and a cutoff handle 116 are rotatably interconnected to the head 104 and move relative to the handle 108. A hook 120 is also rotatably interconnected to the head 104 and is adapted to fix the tension of a band inserted into the head 104. The head 104 also accommodates a blade 124 that is operatively associated with a knife 128. As in the existing banding tools, a front gripper 132 is used to tension the band by operation of the tension handle 112. The operation of this embodiment of the present invention is very similar to that shown and described in U.S. Pat. No. 5,566,726 mentioned above.

Figure 7:
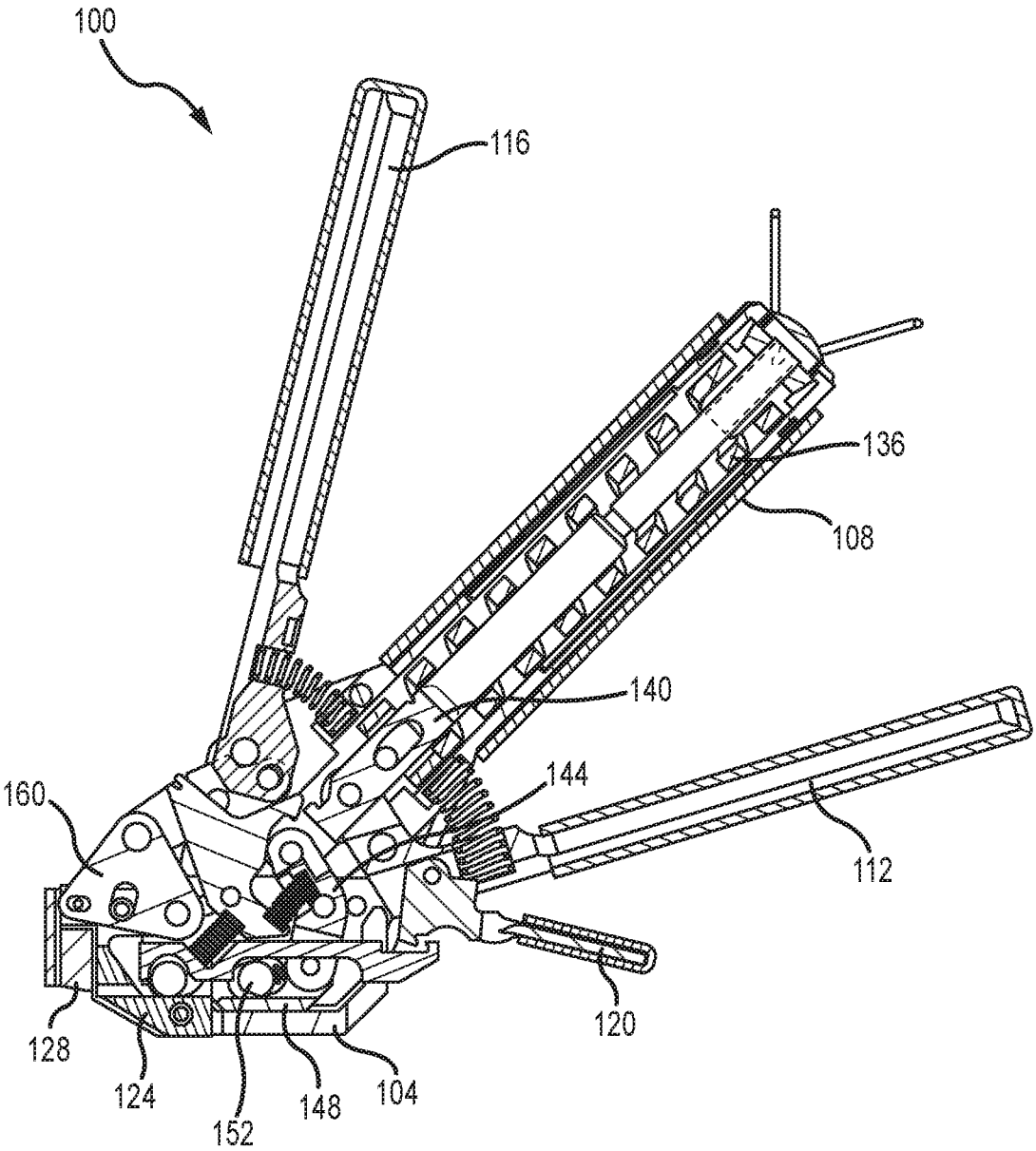
FIG. 7 is a cross-sectional view of one embodiment of the present invention.
Figure 8:
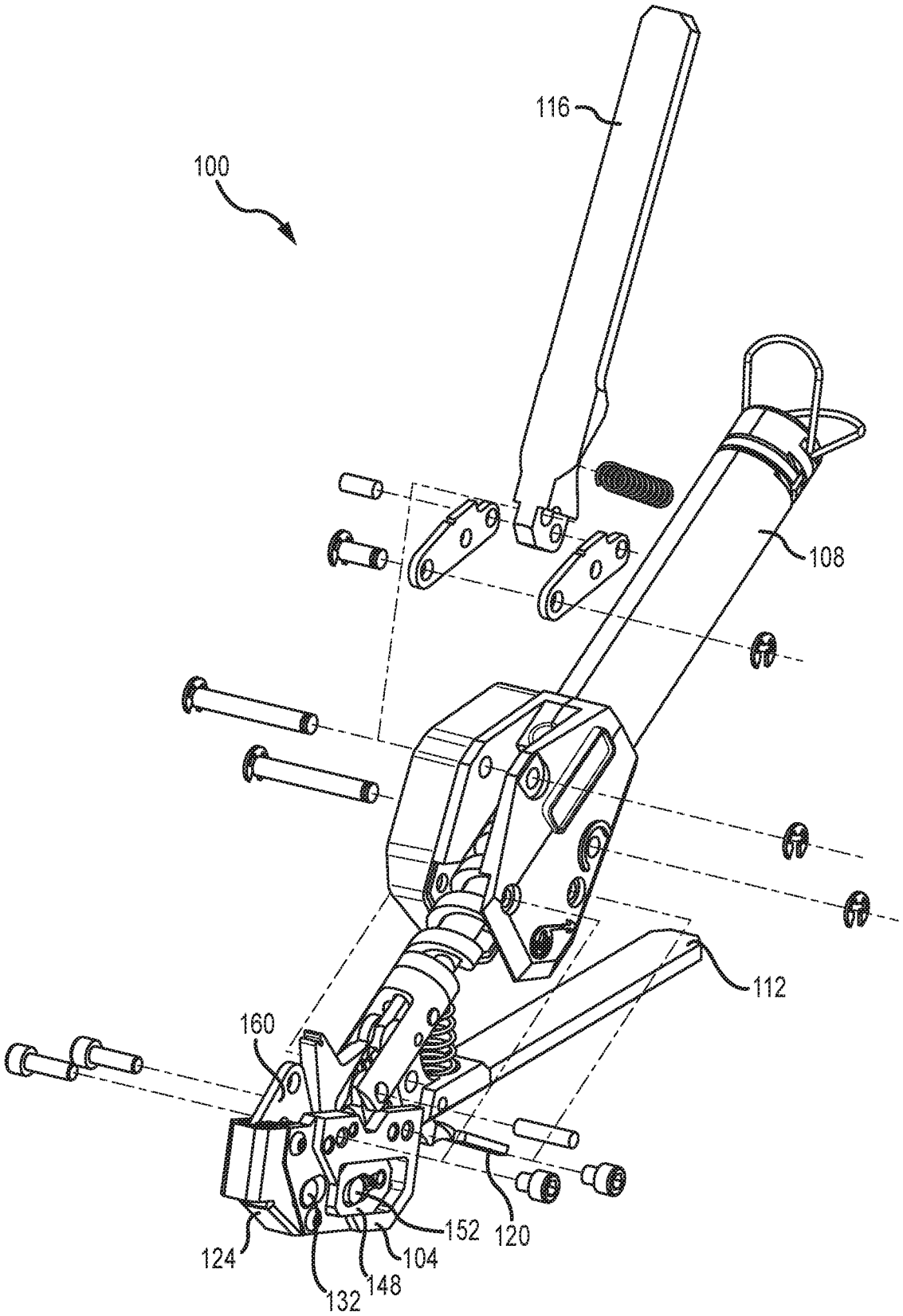
FIG. 8 is a partially exploded view of one embodiment of the present invention.
Figure 9:
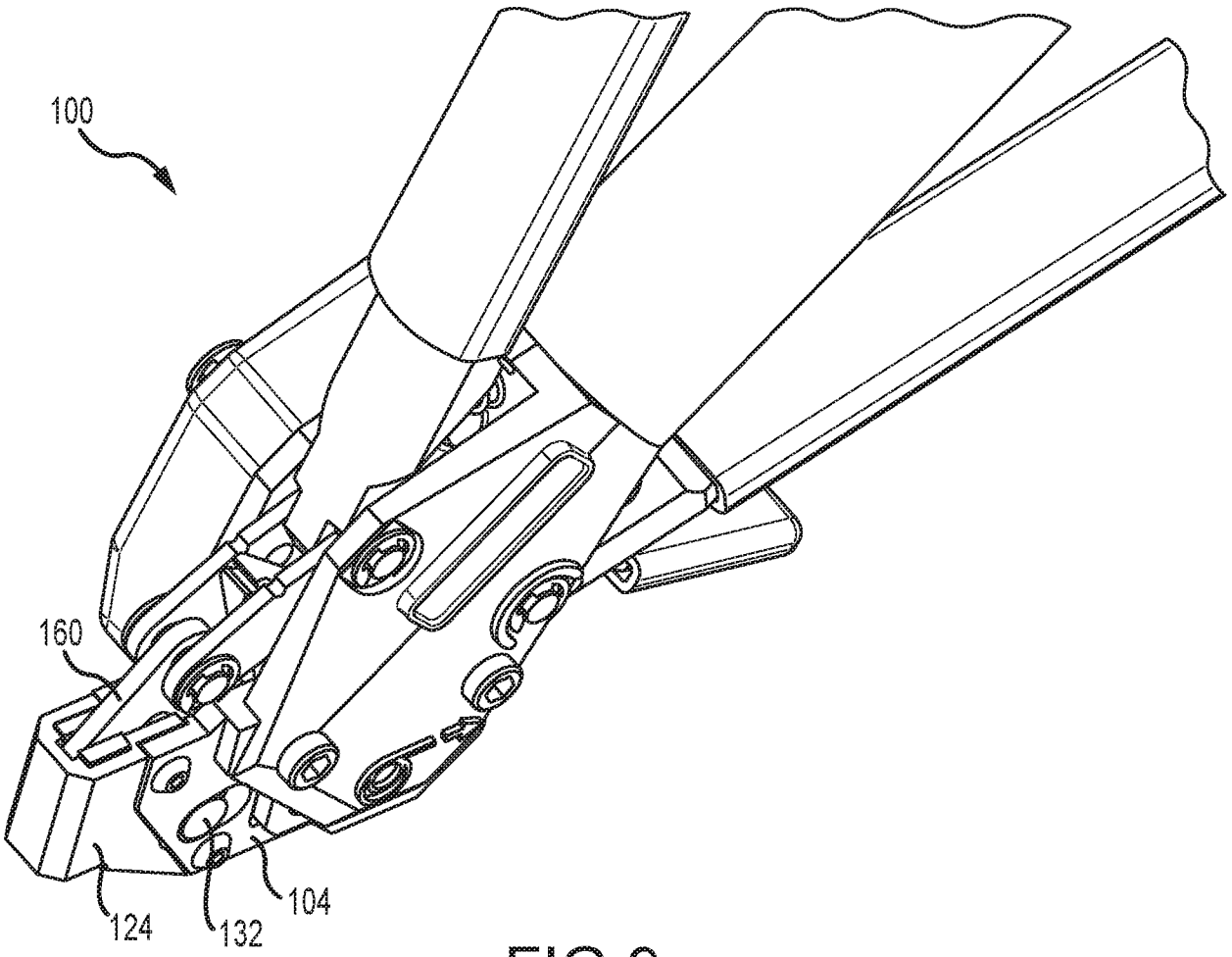
FIG. 9 is a top perspective view of one embodiment of the present invention.

FIGS. 7 and 8 show the inner workings of one embodiment of the present invention. The handle 108 includes a spring 136 that is positioned about a rod 140. The rod 140 cooperates with a transfer lever 144 to dictate the amount of tension that can be applied to the band. In operation, the tension handle 112 is cycled toward and away from the handle 108 to move a tension block 148 and a gripper to tension the band 156. Again, the spring 136 position within the handle 108 will dictate the maximum tension that can be applied to the band as discussed in U.S. Pat. No. 5,566,726. Once the desired tension is achieved, the hook 120 is moved toward the handle 108 to lock the band at the desired tension. The cutoff handle 116 then is rotated towards the handle 108 which rotates the cutter arm 160 and moves the knife 128 downwardly to sever the band 156. Again, the mechanism contemplated by this embodiment of the present invention is similar to the Applicant's patents mentioned above.

Figure 10:
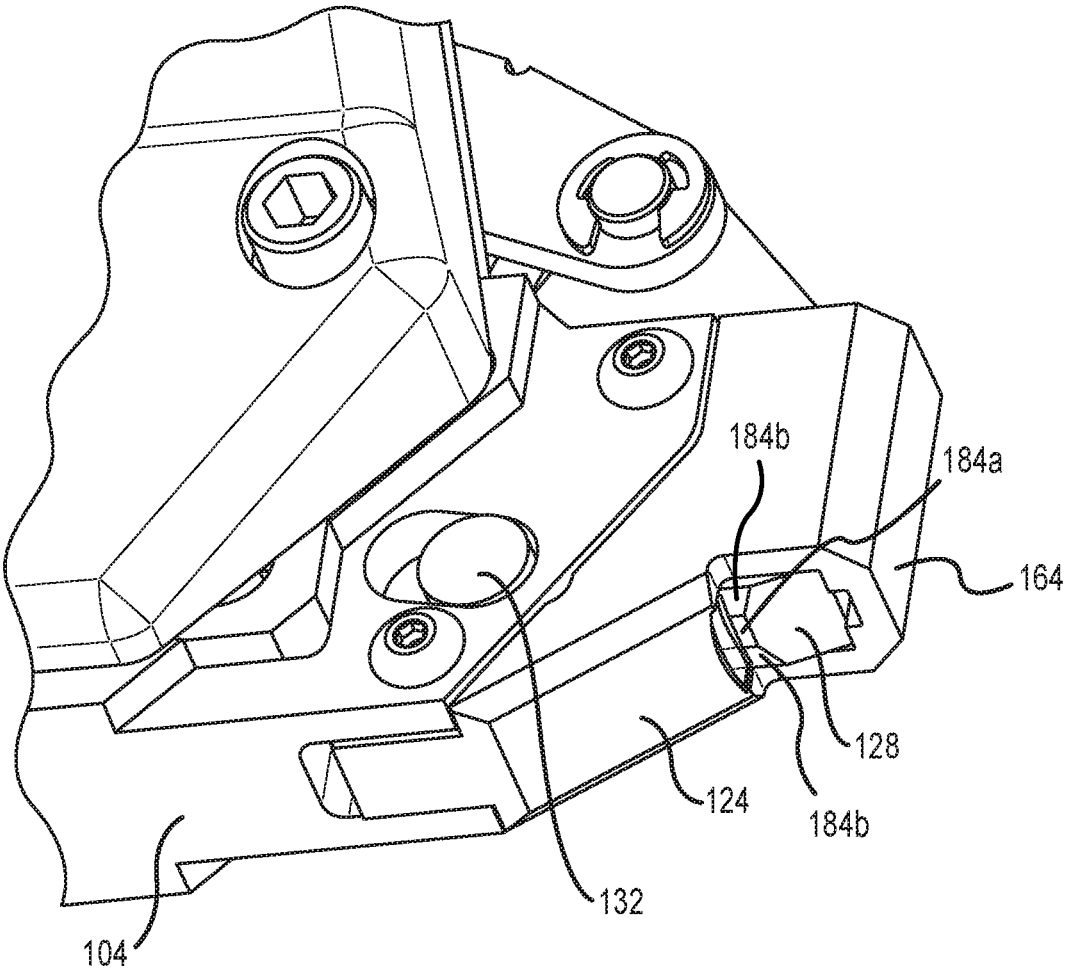
FIG. 10 is a detailed view of a blade of one embodiment of the present invention.
Figure 13:
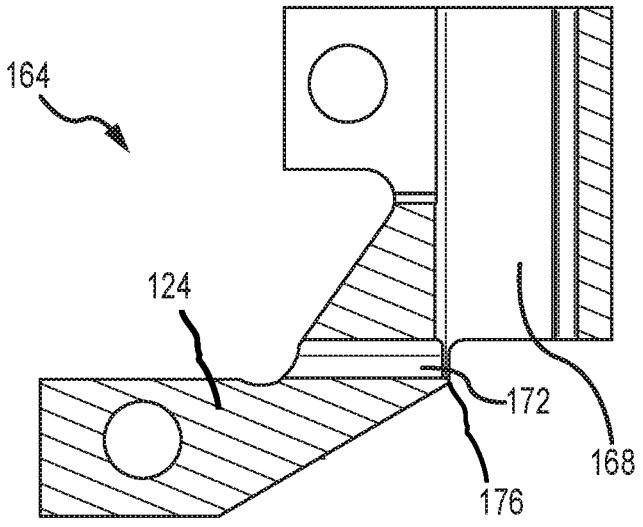
FIG. 13 is a cross-sectional view of the blade of one embodiment of the present invention.

FIGS. 9-13 show the improved blade 124 and knife 128 of some embodiments of the present invention. More specifically, the blade of the prior art is replaced by a housing 164, that is statically interconnected to the head 104. The housing 164 includes the blade 124 with an integrated knife channel 168. The knife channel 168 may have a square profile that prevents significant rotation of the knife 128 within the knife channel 168. The blade 124 also includes a channel 172 for receipt of the band. As shown in FIG. 10, the knife 128 includes a deformation surface 184 formed by a center surface 184*a* and first and second side surfaces 184*b* extending laterally from and oriented at an angle relative to the center surface 184*a*. As shown in FIG. 13, the band channel 168 is adapted to receive a band such that the blade edge is positioned beneath the band and a knife 128 is positioned above the band.

Figure 11:
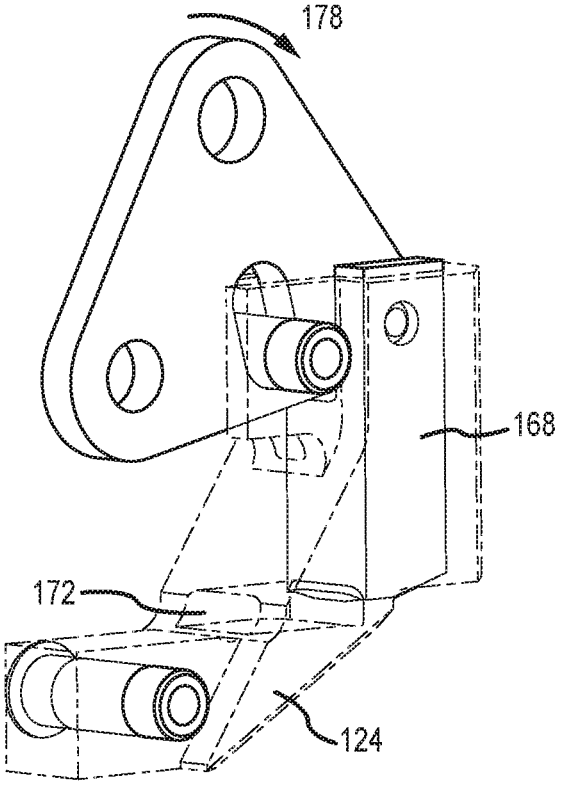
FIG. 11 is a perspective view showing the blade and knife one embodiment of the present invention.
Figure 12:
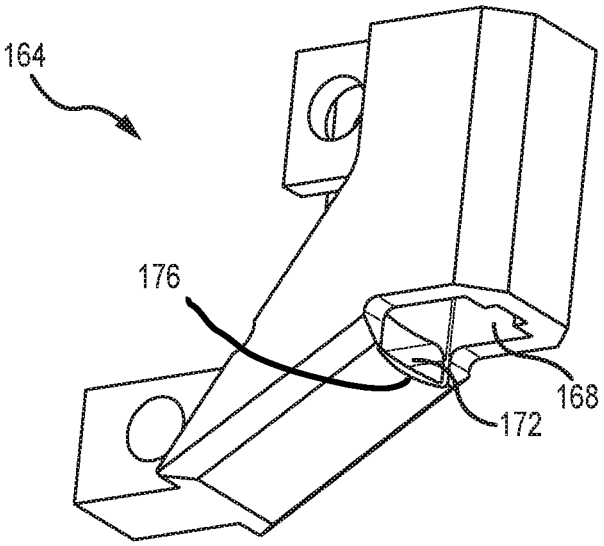
FIG. 12 is a perspective view of the blade of one embodiment of the present invention.

Referring to FIG. 11, in operation, when the cutoff handle 116 is actuated, the cutter arm 160 rotates along arrow 178, which moves the knife 128 downwardly to sever the band. As described in detail below, this configuration maintains a tolerance between the blade edge and the knife 128 such that stainless steel bands can be severed.

Figure 14:
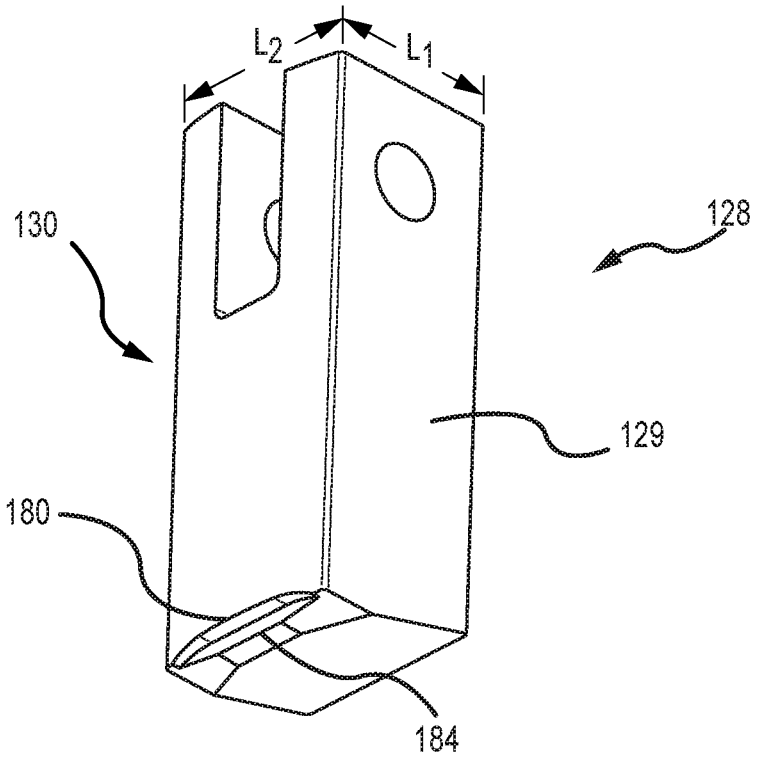
FIG. 14 is a perspective view showing the knife of one embodiment of the present invention.

FIG. 14 shows the knife 128 of one embodiment of the present invention. The knife 128 has a longitudinal dimension $L^1$ that is parallel to the length of a band position in the channel 172 and a lateral dimension $L_2$ that extends between lateral surfaces 129 and 130. The knife 128 includes a cutting edge 180 and a deformation surface 184. That is, knife 128 may employ an arcuate cutting edge 180 and a cable tie head deformation surface 184. The cutting edge 180 initially contacts the band 156 and is used with the blade to sever the band. Thereafter, the deformation surface 184 contacts the cable tie's locking feature, e.g., the cable tie head 158, and deforms the same.

Figure 15:
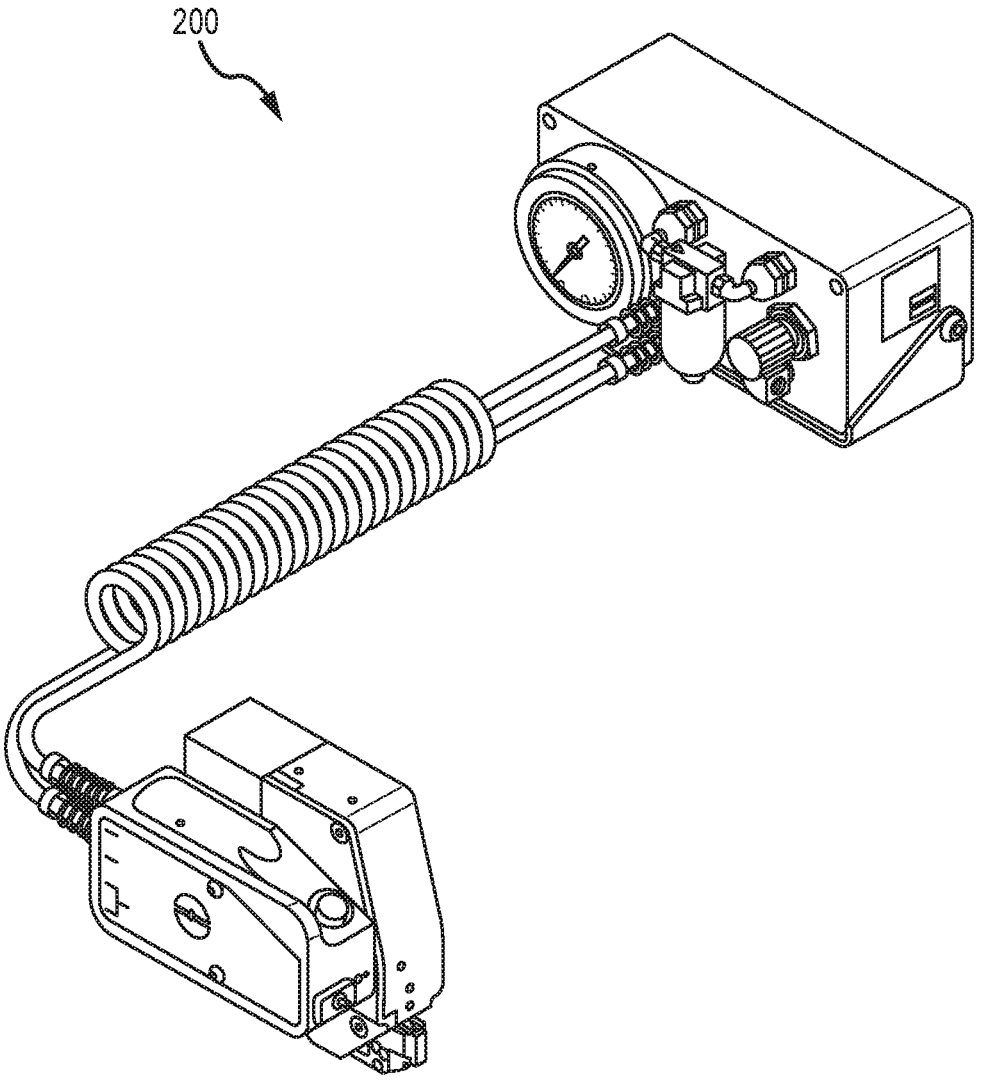
FIG. 15 is an alternative embodiment of the present invention in which the banding tool is a pneumatic device.

As one of ordinary skill will appreciate, the tool described herein can be made to operate pneumatically as shown in FIG. 15. More specifically, the tensioning arm and cutoff handle can replace by a pneumatic system 200 such that pneumatic forces are used to operate the tension block and other associated components described herein. Such systems are described in the Applicant's patent described above.

Figure 16:
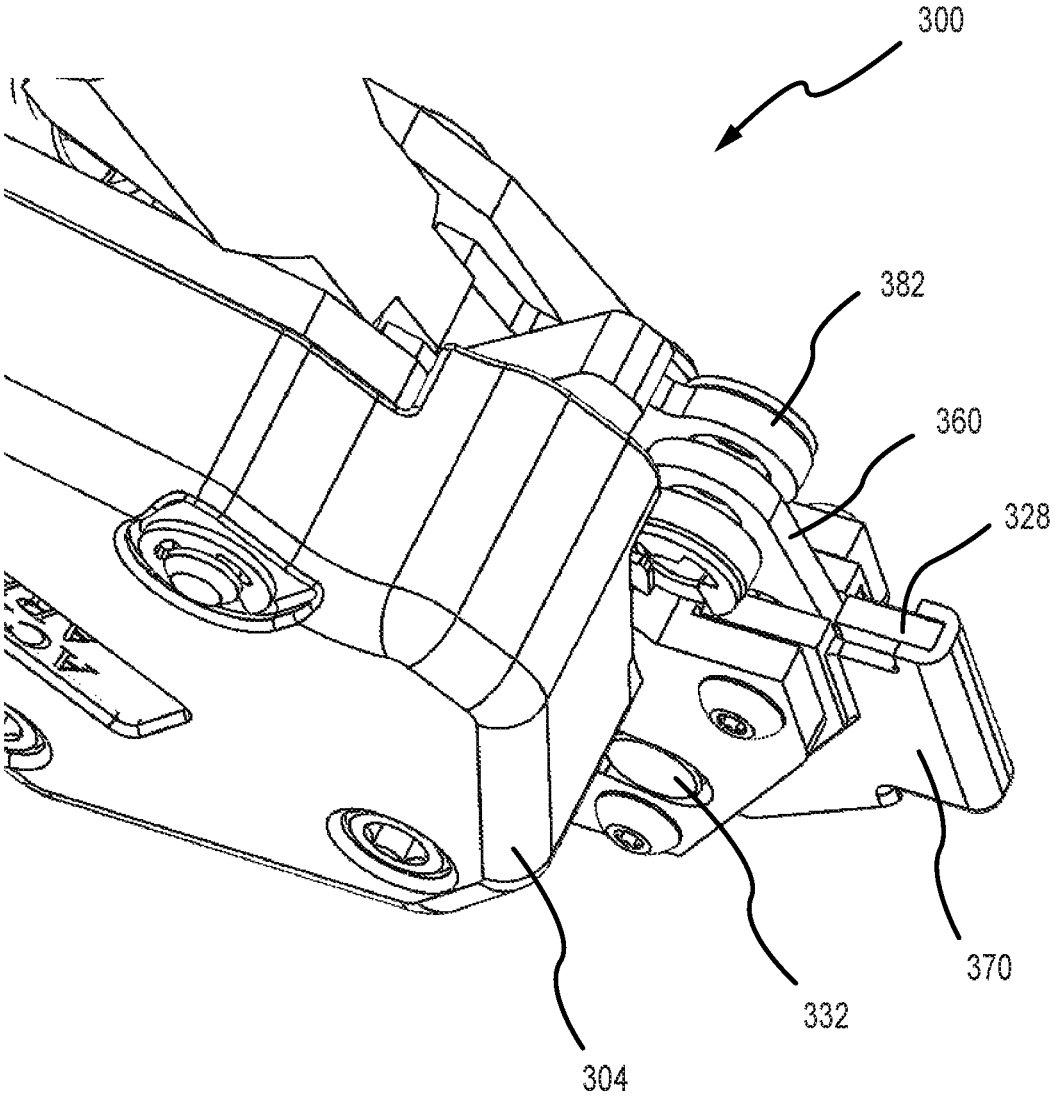
FIG. 16 is a partial top perspective view of a band tensioning device of another embodiment of the present invention.
Figure 17:
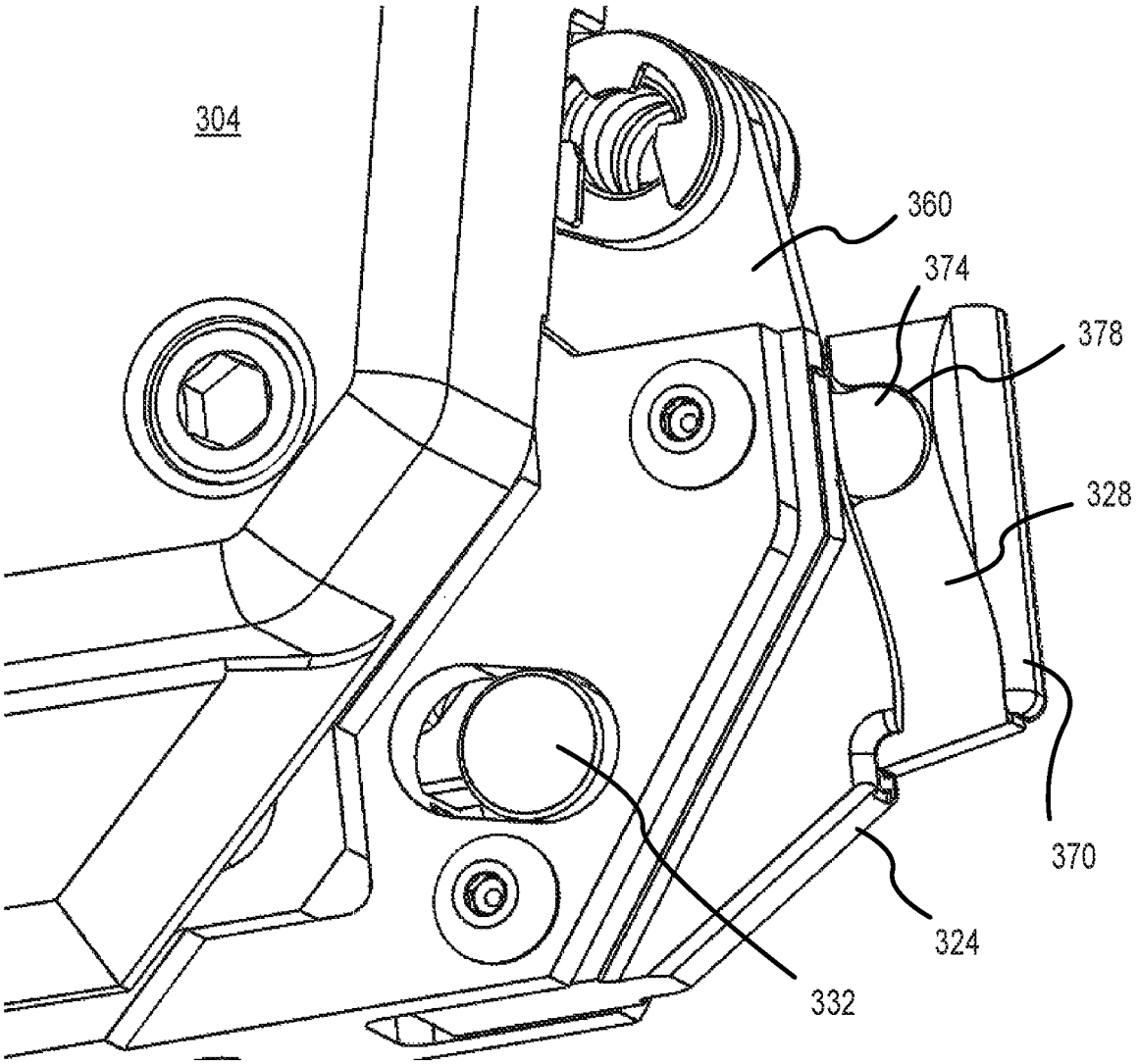
FIG. 17 is a partial front perspective view of the band tensioning device of FIG. 16, wherein the knife is in a first, retracted position of use.
Figure 18:
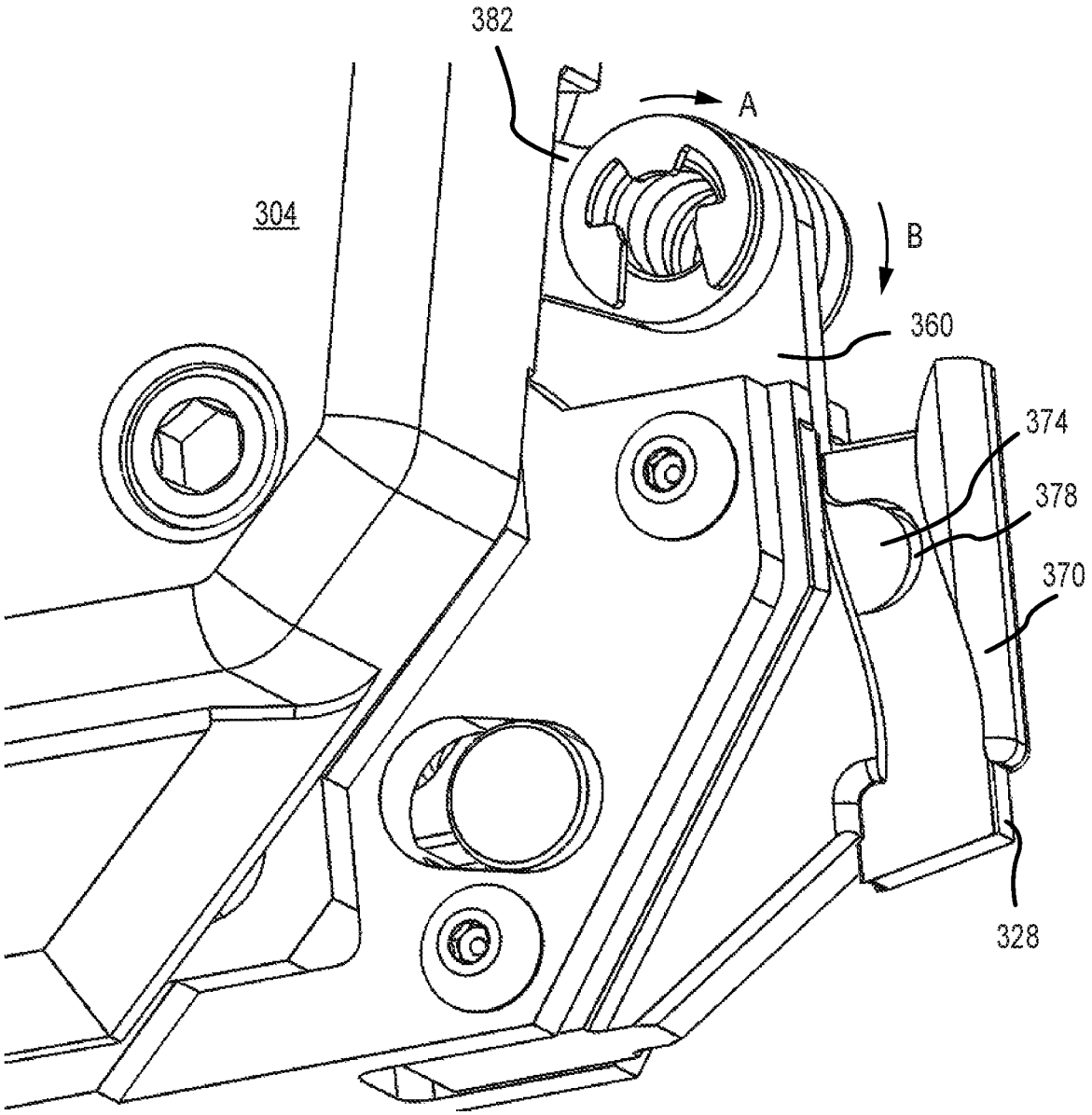
FIG. 18 is a partial front perspective view of the band tensioning device of FIG. 16, wherein the knife is in a second, cutting position of use.
Figure 19:
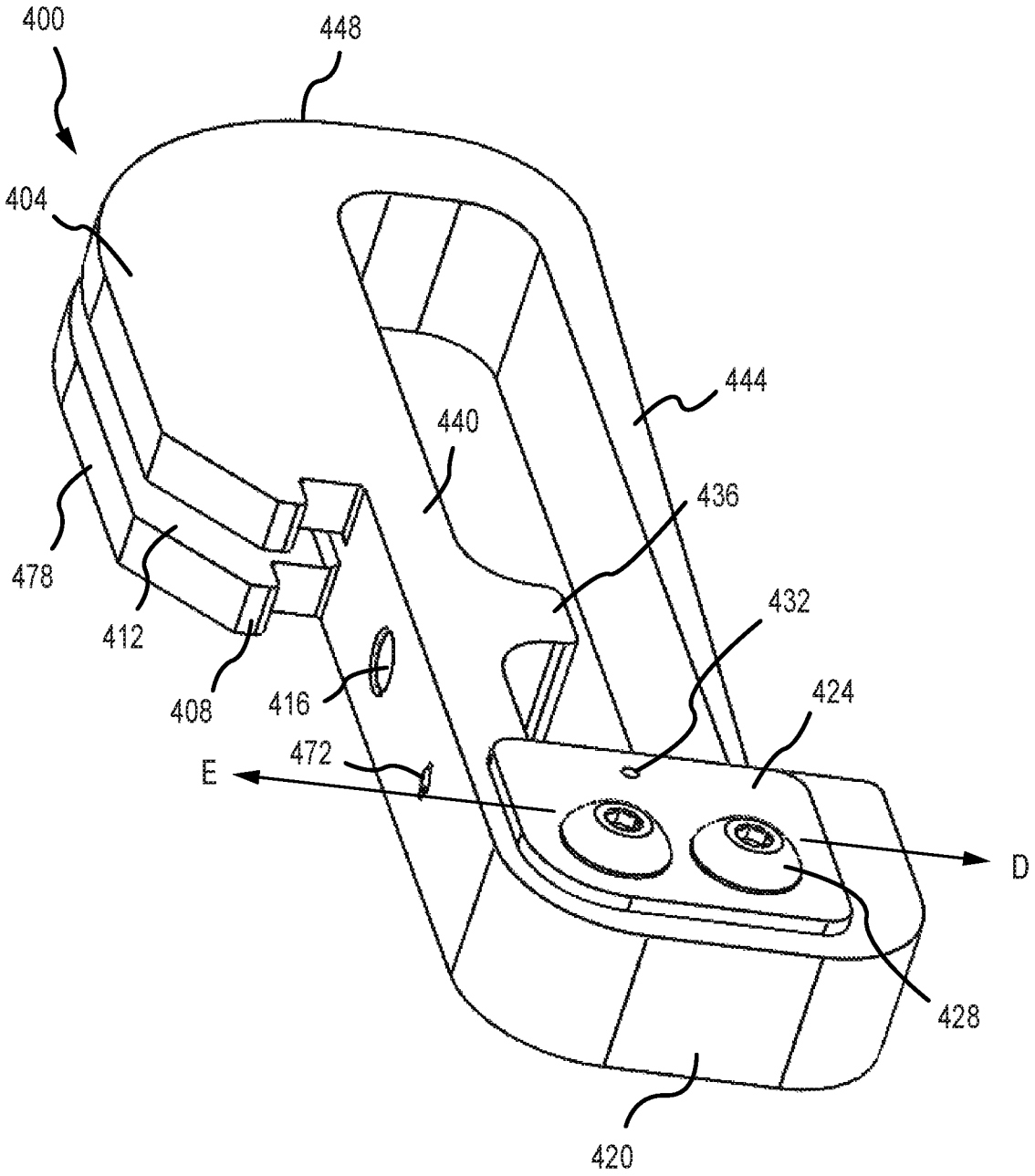
FIG. 19 is a front perspective view of a calibration tool used with the band tensioning device of one embodiment of the present invention.
Figure 20:
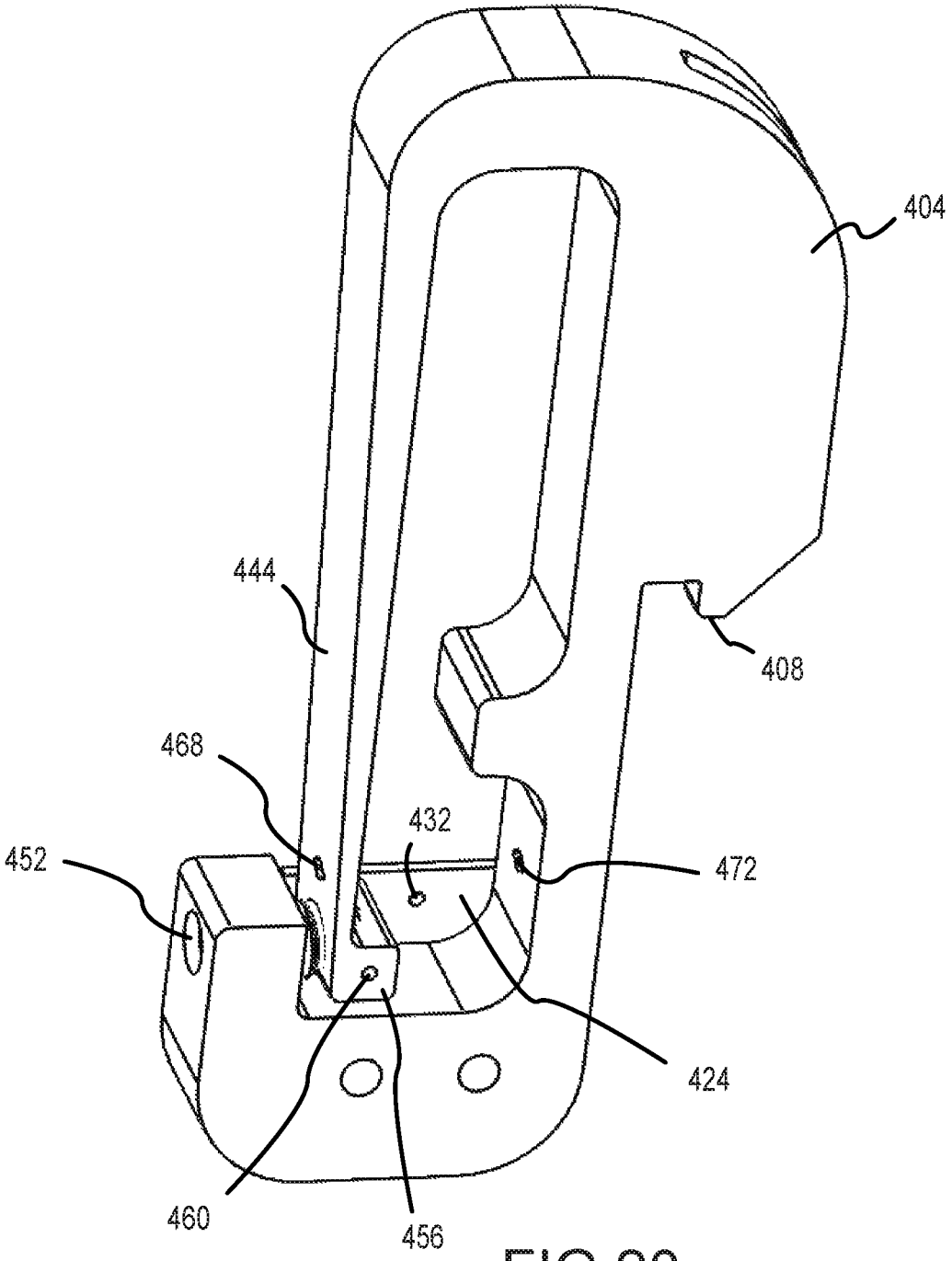
FIG. 20 is a front perspective view of a calibration tool used with the band tensioning device of one embodiment of the present invention.

FIGS. 16-18 show a band tensioning tool 300 of another embodiment of the present invention. Here, the knife 328 and associated components are made thinner to accommodate bands or reduced width. As in the embodiments provided above, the knife 328 travels in a channel provided in a blade housing 370. Because the knife 328 is of a reduced profile, it is impossible to provide a pin/clevis interconnection between a cutter arm 360 and the knife 328.

To address this issue, the cutter arm 360 is provided with a protrusion 374 operatively engaged within a recess 378 provided in the knife 328. The protrusion 374 is designed to travel within the recess when the cutter arm 360 is moved. Again, the knife is moved downwardly by rotation of the cutter arm 360 wherein an edge of the knife cooperates with the blade 324 to sever the band. The operation of one embodiment of the present invention is shown in FIG. 18. Here, when a cutoff handle (See 116 of FIG. 3) is moved, a cutter link 382 moves in the direction of arrow A. The cutter link 382 rotates the cutter arm 360 in the direction of arrow B which forces the protrusion 374 to move downwardly. The protrusion riding in the recess 378 moves the knife 328 downwardly wherein an edge thereof cooperates with an edge of the blade 324 to sever a band. Moving the cutter arm 360 in opposite direction moves the cutter links 382 back into the tool head 304, which rotates the cutter arm 360 and protrusion 374 to retract the knife back into the blade housing 370.

As one of ordinary skill in the art will appreciate, is often desirable to periodically check and adjust the tension output of the tools described above. That is, it is necessary to maintain a tool's tension accuracy to ensure bands are tensioned as expected. Accordingly, calibration devices are normally employed that selectively interconnect to a band tensioning tool to verify the functionality of the same. One drawback of traditional calibration devices is that they are usually complex, require precision parts, are difficult to calibrate themselves, and require considerable operator skill to ensure accurate readings. This last drawback is often due to a lack of visual feedback provided by the calibration tool.

Accordingly, FIGS. 19-23 show a calibration device 400 of one embodiment of the present invention used to calibrate the band tensioning tools described herein. The calibration device 400 includes a gauge body 404 that terminates in a hook 408. The gauge body 404 also includes a slot 412. In operation, the hook 408 is engaged onto a portion of the tool head (see FIG. 21). The slot 412 accepts a portion of the tool's cutter arm which helps properly align the calibration device 400 in the proper location. The calibration device 400 may be further secured to the tool head with a magnet 416.

The calibration device 400 further includes a distal end 420 that secures a plate 424 with slotted holes (not shown). The plate 424 is interconnected to the distal end by at least one screw 428. The plate 424 includes an aperture 432, which will be described in further detail below. Finally, the calibration tool may include a stop 436 located on a stationary arm 440 that spans from the gauge body 404 and the distal end 420. Finally, the calibration device 400 includes a movable arm 444 associated with the gauge body 404 at the calibration tool's proximal end 448. The stop 436 prevents the arm 440 from moving past a predetermined point.

Figure 21:
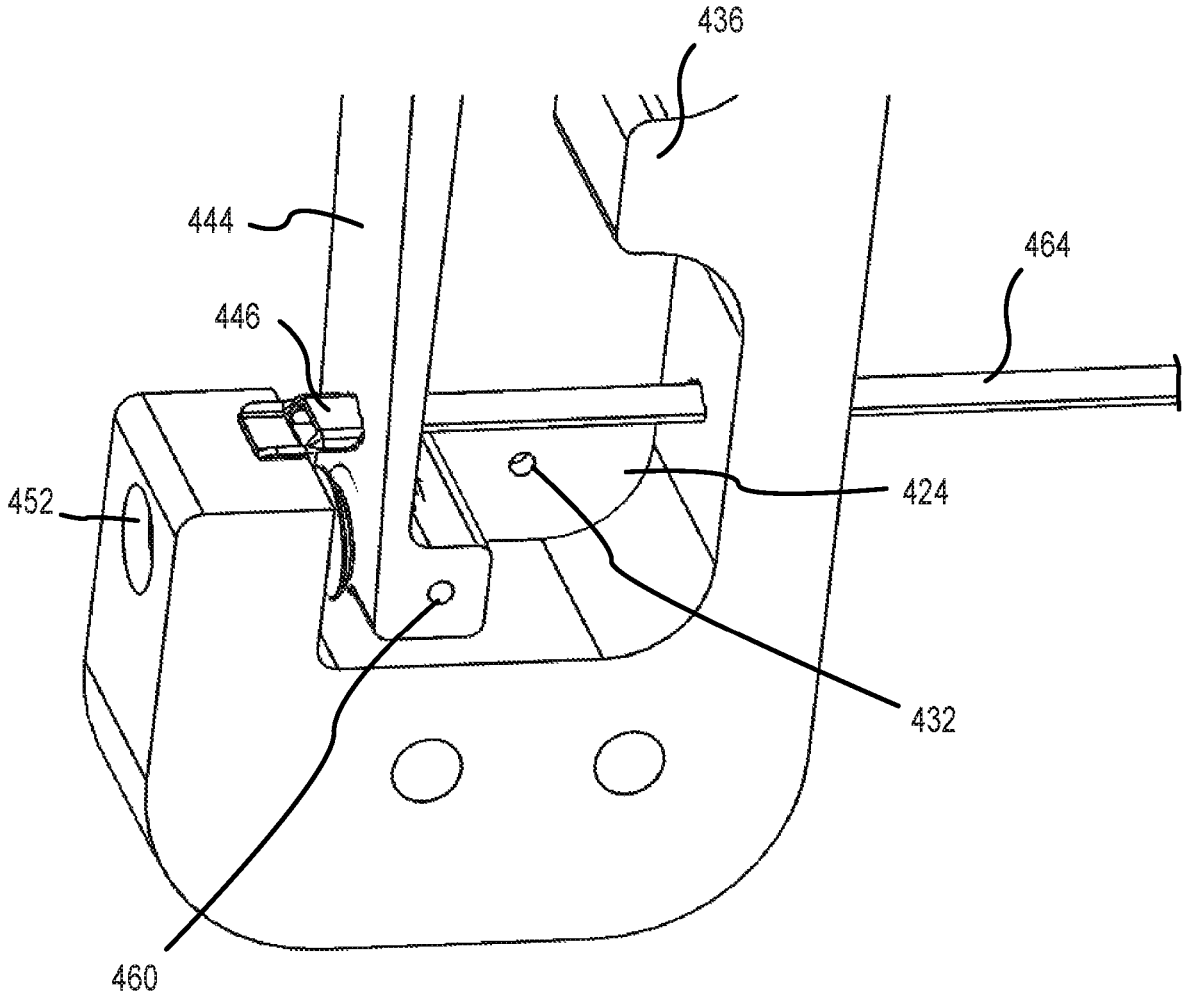
FIG. 21 is a detailed partial perspective view showing a band in the calibration tool.
Figure 22:
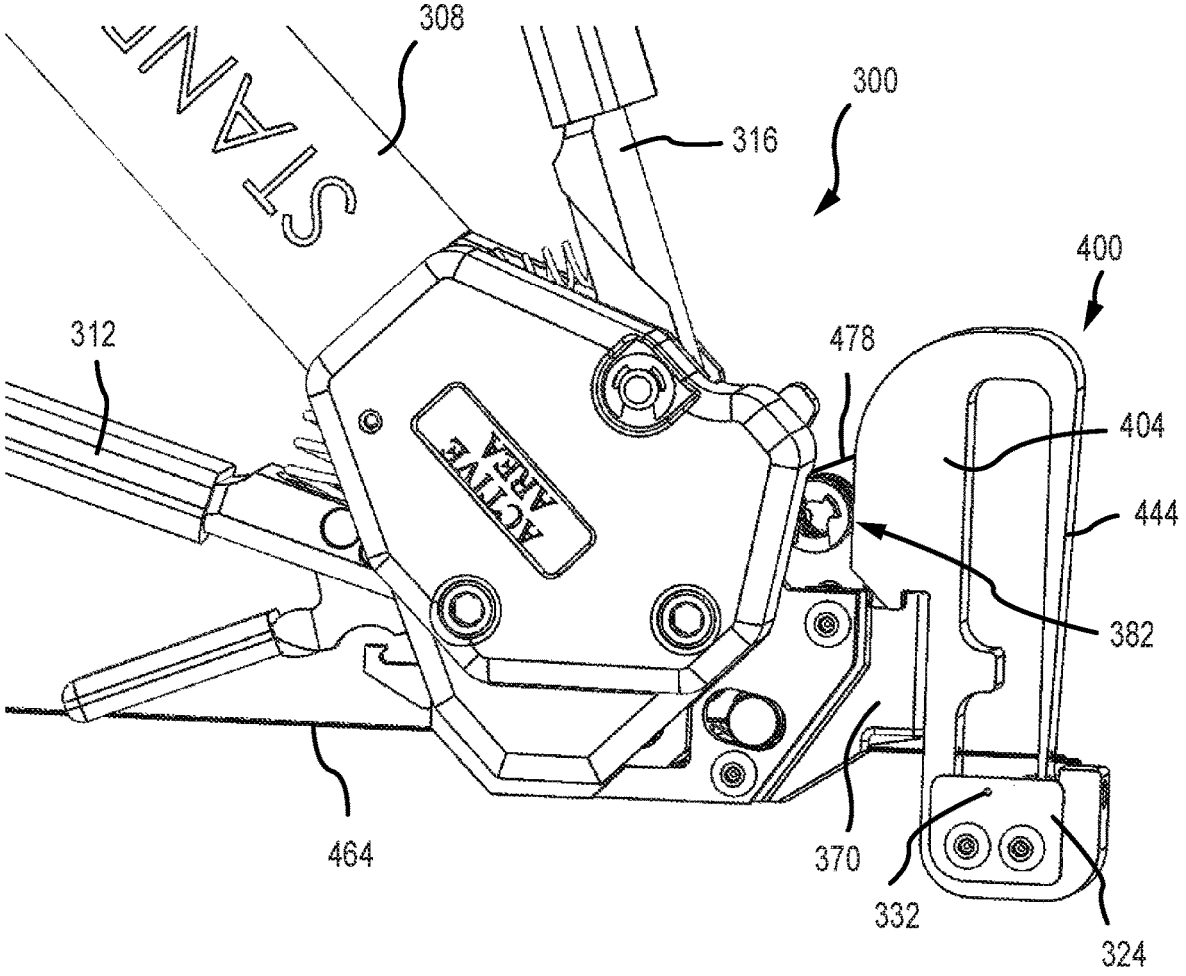
FIG. 22 is a front perspective view of a calibration tool interconnected to a band tensioning tool.
Figure 23:
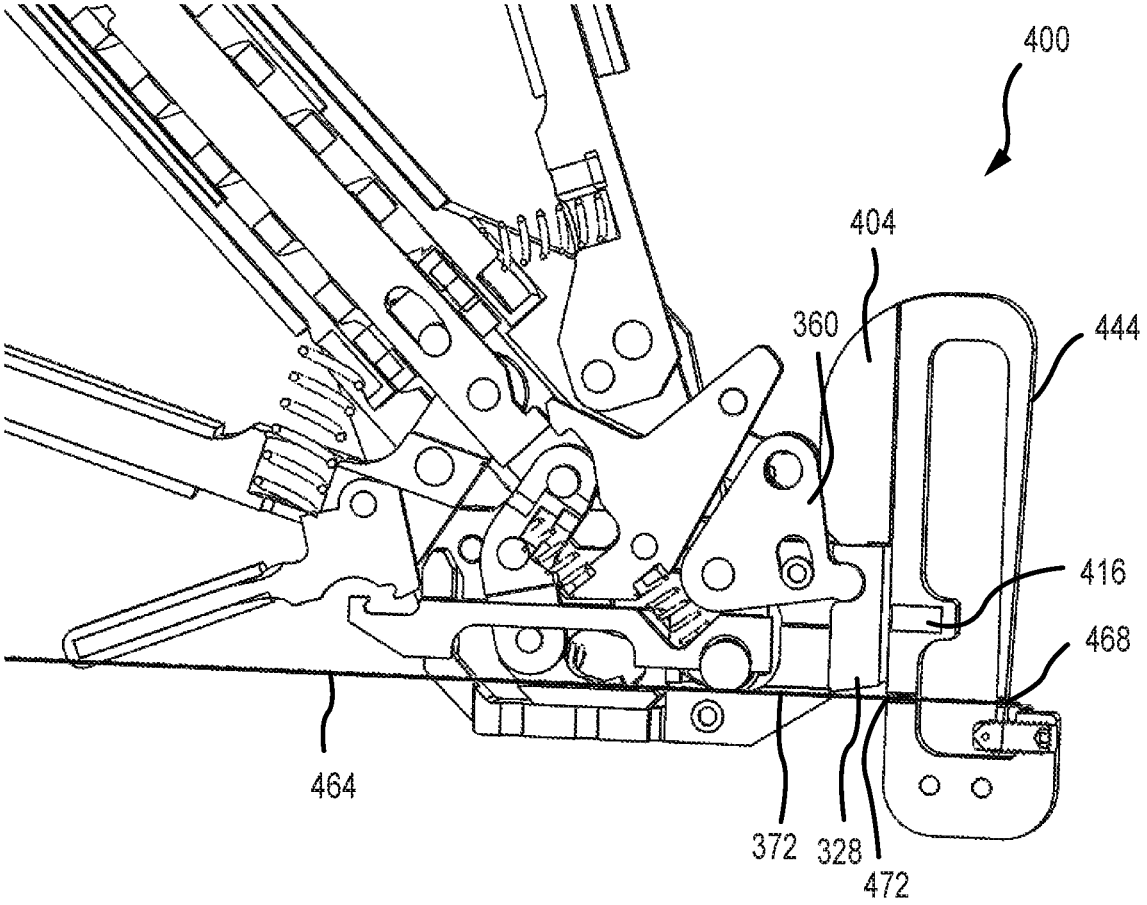
FIG. 23 is a cross sectional view of FIG. 21.
Figure 24:
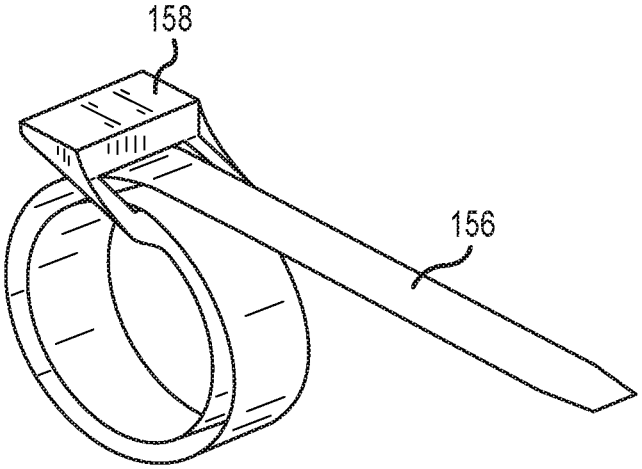
FIG. 24 is a perspective view of one embodiment of a band and buckle.

Some embodiments of the present invention include an adjustment screw 452 that selectively engages an end 456 of the arm 444, whereby the initial location of the movable arm end 456 is set such that the movable arm is pre-loaded towards the stop 436. The movable arm 444 includes an opening 460 that cooperates with the aperture 432 in the plate 424, which will be described in further detail below FIGS. 21-23 illustrate how the calibration device 400 of one embodiment of the present invention is used to calibrate a band tensioning tool 300. As one of ordinary skill the art will appreciate, to accurately calibrate the tension band tensioning tool, the calibration device 400 must first be calibrated. Referring to FIG. 21, calibration device is done by inserting a band 464 through a forward opening 468 in the movable arm 444, wherein the band head 446 is abutted against the movable arm 444. The band 464 is also inserted through a rear opening 472. A predetermined tension is added to the band in the direction of arrow C, which incrementally moves the movable arm end 456 and the movable arm 444 towards the stop 436. The tension applied to the band 464 will move the arm end 456 a predetermined amount. Thereafter, the screws in the plate (428 of FIG. 19) are loosened and the plate 424 is moved along arrow D or E (FIG. 19) to align the aperture 432 and the arm end opening 460. Subsequently, whenever a band positioned within the calibration tool and tensioned with the band tensioning tool to that degree, the aperture 423 and the arm end opening 460 will be aligned.

In operation, the gauge body 404 is first hooked on to an upper portion of the blade housing 370. This aligns the rear opening 472 and the forward opening 468 of the calibration device 400 with the opening provided by the blade housing 470 that receives the free end of the band. Hooking the gauge body 404 onto the blade housing 370 also positions an inner surface 478 of the gauge body 404 in such a way to prevent movement of the cutter link 382, which prevents movement of the knife 328. The slot 412 receives the cutter arms 360 to position the calibration device laterally with respect to the primary axis of the band tensioning tool 300. Finally, the magnet 416 provided by the calibration device will firmly secure it to the blade housing 370.

After the calibration device is secured to the band tensioning tool, a band 464 is placed through the forward opening 468, the rear opening 472, and through the channel 372 provided by the blade housing 370. After the band 464 passes through the channel 372 it engages the gripper members as described above. Cycling of a tension handle 312 towards the handle 308 tensions the band 464 and moves the movable arm 444 towards the stop 436. When a predetermined tension is achieved, (i.e., the tension the calibration device was tested to—the calibration tension), as indicated by the band tensioning tool, the operator assesses the aperture 432 positioned in the plate and the arm opening 460. If the aperture 432 and the opening 460 are aligned, the tension provided by the tool equals the calibration tension. If the aperture 432 and the opening 460 do not coincide, the applied tension is incorrect and the band tensioning tool must be repaired.

Alternatively, tension may be applied until the aperture 432 and the opening 460 are aligned and a tension reading is obtained from the tool. If the tension reading does not correspond with the calibration tension, the band tensioning tool must be adjusted.

This method of assessing band tension is ideal as light passing through the aligned openings will indicate a predetermined tension has been achieved. That is, when the apertures 432 and the opening 460 are in line, light will shine through the calibration tool. One of ordinary skill in the art will appreciate the light coming through pin holes and solid bodies are very detectable by the human eye. Prior art tools rely on the ability of the operator to find markings, which is which may be fraught with errors.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A band cutting apparatus for a banding tool, comprising:

a primary handle;

a band cut off handle configured to move towards the primary handle;

a cutter arm operatively interconnected to the cut off handle;

a knife configured to move linearly between a first position and a second position, the knife having a recess, a cutting edge and a deformation surface, the recess configured to receive a protrusion of the cutter arm, wherein engagement of the protrusion within the recess operatively interconnects the cutter arm to the knife;

a blade housing having a first channel for operative receipt of the knife, the knife positioned away from an open, distal end of the first channel when in the first position, and positioned adjacent to the distal end of the first channel when in the second position, and a second channel adapted to receive a band, the second channel oriented perpendicular to the first channel and having a first opening near the distal end of the first channel, and a second opening spaced from the first opening, the first opening further comprising a blade edge that cooperates with the cutting edge of the knife to sever the band positioned in the second channel between the distal end of the first channel and the blade edge, the second channel having a width to receive the band wherein the width defines a lateral direction;

the knife cutting edge having a curved shape that extends in the lateral direction across the knife;

the knife deformation surface spaced from the cutting edge and having a center planar surface and a first and a second planar side surface, the center planar surface having a first side edge and a second side edge spaced laterally from and not co-linear with the first side edge, the first planar side surface abutting the center planar surface along the first side edge and extending outwardly in the lateral direction from the first side edge of the center planar surface at an angle relative to the center planar surface and the second planar side surface abutting the center planar surface along the second side edge and extending in the lateral direction outwardly from the second side edge of the center planar surface at an angle relative to the center planar surface.

2. The apparatus of claim 1, wherein said first channel has an internal profile, comprising a first planar surface, a second planar surface, and a third planar surface, wherein said second and third planar surfaces are generally orthogonal to said first planar surface.

3. The apparatus of claim 2, wherein said knife has a first surface and a second surface that correspond with the second planar surface and the third planar surface of the first channel.

4. The band cutting apparatus of claim 2, wherein said second channel has an internal profile comprising a first planar surface and a second planar surface positioned parallel to and spaced from said first planar surface, and a third planar surface and a fourth planar surface positioned parallel to and spaced from said third planar surface, and wherein said first and second planar surfaces of said second channel are orthogonal to said third and fourth planar surfaces of said second channel.

5. The apparatus of claim 1, wherein the blade housing is a single homogenous piece of material.

6. The apparatus of claim 1, further comprising means for interconnecting the knife to said cutter arm.

7. The apparatus of claim 6, wherein the knife is operatively interconnected to the cutter arm by way of a pin, wherein rotation of the cutter arm moves the knife from the first position to the second position.

8. The apparatus of claim 1, wherein walls of the first channel substantially correspond with an outer profile of the knife.

9. A banding tool comprising:

a cutter arm;

a single piece blade member having a first channel defined by a first planar surface and a second planar surface, the first channel defining a first opening and configured to receive a band, and a blade edge spaced from the first opening, a knife having a first lateral surface that aligns with the first planar surface of the first channel and a second lateral surface that aligns with the second planar surface of the first channel, and having a recess configured to operatively receive a protrusion of the cutter arm, wherein rotation of the cutter arm moves the knife linearly between the first and second lateral surfaces from a first position to a second position, the linear motion defining a longitudinal axis of the knife, the knife having a curved band cutting edge that extends from the first lateral surface to the second lateral surface and is oriented in a plane parallel with the longitudinal axis of the knife, and a buckle deformation portion having a center planar surface and a first and a second planar side surface, the first planar side surface abutting the center planar surface and extending laterally between the first lateral surface and the second lateral surface at an angle relative to the center planar surface and the second planar side surface abutting the center planar surface and extending laterally between the first lateral surface and the second lateral surface at an angle relative to the center planar surface.

10. The banding tool of claim 9, wherein the blade member includes a second channel adapted to receive the band, the second channel positioned orthogonal to the first channel and having a second opening near the first opening of the first channel, and a third opening spaced from the second opening, the second opening comprising the blade edge.

11. A band cutting apparatus for a banding tool, comprising:

a head;

a cutoff handle operatively associated with said head;

a tension handle associated with said head;

a cutter arm rotatably interconnected to said head;

a blade housing having a first channel and a second channel, said first channel having a first end with a first opening and a second end with a second opening, said first channel adapted to receive a knife, said second channel have a first end with a first opening and a second end with a second opening, said second channel adapted to receive a band and the width of said second channel defining a lateral direction, said first opening of said first channel being proximate and spaced from said first opening of said second channel, and a blade edge proximate said first opening of said second channel and wherein said first channel, said second channel, and said blade edge are formed as a monolithic structure;

a knife positioned within said first channel of said blade housing, said knife having a recess for receipt of a protrusion of said cutter arm, which operatively interconnects said cutter arm to said knife, wherein movement of the cutter arm initiated by movement of said cutoff handle moves said knife linearly within said first channel between a first position distal from said blade edge to a second position proximate said blade edge, and said knife having a curved cutting edge that extends in the lateral direction across said knife and a deformation surface spaced from said cutting edge and having a center planar surface and a first and a second planar side surface, said center planar surface having a first side edge and a second side edge laterally spaced from said first side edge, said first planar side surface abutting said center planar surface along said first side edge and extending in the lateral direction laterally outwardly from said first side edge of said center planar surface at an angle relative to said center planar surface and said second planar side surface abutting said center planar surface along said second side edge and extending laterally outwardly from said second side edge of said center planar surface at an angle relative to said center planar surface.

12. The apparatus of claim 11, wherein said first channel has an internal profile, comprising a first planar surface, a second planar surface, and a third planar surface, wherein said second and third planar surfaces are generally orthogonal to said first planar surface.

13. The apparatus of claim 12, wherein said knife has a first surface and a second surface that correspond with said second planar surface and said third planar surface of said first channel.

14. The apparatus of claim 11, wherein said first channel and second channel are orthogonal.

15. The apparatus of claim 11, wherein movement of said knife between said first position and said second position defines a longitudinal direction and said deformation surface is longitudinally spaced from said cutting edge.

16. The apparatus of claim 11, wherein walls of said first channel substantially correspond with an outer profile of said knife.

* * * * *